US009532608B2

(12) United States Patent
Tsang et al.

(10) Patent No.: US 9,532,608 B2
(45) Date of Patent: Jan. 3, 2017

(54) ELECTRICAL CONNECTOR

(71) Applicant: Tyco Electronics Corporation, Berwyn, PA (US)

(72) Inventors: Albert Tsang, Harrisburg, PA (US); Matthew McAlonis, Elizabethtown, PA (US); Chong Hun Yi, Mechanicsburg, PA (US); Dustin Carson Belack, Hummelstown, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 50 days.

(21) Appl. No.: 14/147,068

(22) Filed: Jan. 3, 2014

(65) Prior Publication Data

US 2014/0213074 A1 Jul. 31, 2014

Related U.S. Application Data

(63) Continuation-in-part of application No. 13/755,875, filed on Jan. 31, 2013, now Pat. No. 9,048,584.

(51) Int. Cl.

| | |
|---|---|
| ***H01R 13/52*** | (2006.01) |
| ***A41D 1/00*** | (2006.01) |
| ***H01R 13/518*** | (2006.01) |
| *H01R 12/81* | (2011.01) |
| *H01R 24/62* | (2011.01) |

(52) U.S. Cl.

CPC ..... *A41D 1/005* (2013.01); *H01R 13/518* (2013.01); *H01R 13/5213* (2013.01); *H01R 12/81* (2013.01); *H01R 24/62* (2013.01)

(58) Field of Classification Search

CPC ..... H01R 13/5219; H01R 13/5208; H01R 13/65802; H01R 23/7073; G02B 6/3897; G02B 6/3893; G02B 6/3821

USPC ..... 439/271, 587, 607.01, 660; 385/53, 58, 385/60

See application file for complete search history.

(56) References Cited

U.S. PATENT DOCUMENTS

| | | | | |
|---|---|---|---|---|
| 3,336,569 | A * | 8/1967 | Nava | 439/589 |
| 3,634,811 | A * | 1/1972 | Teagno | H01R 13/28 439/290 |
| 4,537,456 | A * | 8/1985 | Brown | H01R 4/2466 439/293 |
| 4,705,339 | A * | 11/1987 | Hayes et al. | 439/277 |
| 4,735,480 | A * | 4/1988 | Levinson | G02B 6/3821 385/58 |
| 4,737,118 | A * | 4/1988 | Lockard | H01R 23/27 439/293 |
| 4,741,590 | A * | 5/1988 | Caron | G02B 6/3825 385/60 |
| 5,073,127 | A * | 12/1991 | Daly et al. | 439/473 |
| 5,562,477 | A * | 10/1996 | Moore et al. | 439/383 |

(Continued)

*Primary Examiner* — Thanh Tam Le

(57) ABSTRACT

A wearable connector includes a housing having a base and a shroud that extends from the base. The shroud includes a tunnel having an open end and an interior surface. The open end of the tunnel is configured to receive a mating connector therein. The base is configured to be mounted to a wearable article. Terminals are held directly by the shroud such that mating segments of the terminals extend at least one of directly on or through the interior surface of the tunnel. The tunnel of the shroud is configured to receive the mating connector into the tunnel through the open end such that the mating segments of the terminals mate with mating terminals of the mating connector within the tunnel.

20 Claims, 14 Drawing Sheets

(56) References Cited

U.S. PATENT DOCUMENTS

| | | | | |
|---|---|---|---|---|
| 5,613,025 | A * | 3/1997 | Grois | G02B 6/3831 385/53 |
| 5,883,995 | A * | 3/1999 | Lu | G02B 6/3807 385/53 |
| 5,923,805 | A * | 7/1999 | Anderson | G02B 6/3825 385/139 |
| 6,290,527 | B1 * | 9/2001 | Takaya | G02B 6/389 385/76 |
| 6,357,930 | B1 * | 3/2002 | Wiltjer | G02B 6/3831 385/53 |
| 6,422,759 | B1 * | 7/2002 | Kevern | G02B 6/3825 385/58 |
| 6,837,625 | B2 * | 1/2005 | Schott | G02B 6/4248 385/60 |
| 7,341,381 | B2 * | 3/2008 | Shimoji | G02B 6/3893 385/60 |
| 7,481,584 | B2 * | 1/2009 | Cairns | 385/60 |
| 7,744,288 | B2 * | 6/2010 | Lu | G02B 6/3816 385/60 |
| 7,874,869 | B2 * | 1/2011 | Chern | H01R 13/518 439/540.1 |
| 7,878,824 | B2 * | 2/2011 | Pepe | H01R 13/40 439/607.02 |
| 8,241,062 | B2 * | 8/2012 | Tsuruta | 439/589 |
| 8,257,107 | B2 * | 9/2012 | Tsuruta et al. | 439/362 |
| 8,382,382 | B2 * | 2/2013 | Nelson | G02B 6/3825 385/55 |
| 8,517,614 | B1 * | 8/2013 | Wach | G02B 6/38 385/59 |
| 9,048,584 | B2 * | 6/2015 | Thackston et al. | |

* cited by examiner

ELECTRICAL CONNECTOR

CROSS REFERENCE TO RELATED APPLICATIONS

This application is a continuation-in-part application of U.S. patent application Ser. No. 13/755,875, filed Jan. 31, 2013, and titled ELECTRICAL CONNECTOR, the subject matter of which is herein incorporated by reference in its entirety.

BACKGROUND OF THE INVENTION

The subject matter described and/or illustrated herein relates generally to electrical connectors.

Electrical connector system are used to electrically connect a wide variety of electronic devices. But, known electrical connectors are not without disadvantages. One disadvantage of some known electrical connectors is that terminals of the electrical connector may be difficult to adequately clean in the field, which may interfere with operation of the electrical connector (e.g., may prevent the electrical connector from mating, and thereby establishing an electrical connection, with a complementary connector). For example, the mating interface of some known electrical connectors is shrouded, which may enable the collection of debris between and/or around the terminals of the mating interface. Such debris may not be easily cleaned in the field. Moreover, attempts to clean debris from a shrouded mating interface may damage the terminals of the connector.

Another disadvantage of some known electrical connectors is vulnerability to liquid and/or moisture (e.g., water, a corrosive liquid, an acidic liquid, and/or the like). For example, some known electrical connectors may be used in environments wherein the connector is exposed to a liquid and/or moisture. Exposure of the mating interface of an electrical connector to a liquid and/or moisture may interfere with operation of the electrical connector. For example, exposure of the mating interface of an electrical connector to a liquid and/or moisture may prevent the electrical connector from conducting electrical power and/or electrical data signals.

BRIEF DESCRIPTION OF THE INVENTION

In an embodiment, a wearable connector includes a housing having a base and a shroud that extends from the base. The shroud includes a tunnel having an open end and an interior surface. The open end of the tunnel is configured to receive a mating connector therein. The base is configured to be mounted to a wearable article. Terminals are held directly by the shroud such that mating segments of the terminals extend at least one of directly on or through the interior surface of the tunnel. The tunnel of the shroud is configured to receive the mating connector into the tunnel through the open end such that the mating segments of the terminals mate with mating terminals of the mating connector within the tunnel.

In an embodiment, a connector includes a housing having a base and a shroud that extends from the base. The shroud includes a tunnel. The tunnel extends a length from a first open end to a second open end. Terminals are held by the shroud such that mating segments of the terminals extend within the tunnel. The tunnel is configured to selectively receive a mating connector therein through the first open end or through the second open end such that the terminals mate with mating terminals of the mating connector within the tunnel.

In an embodiment, a connector system includes a holder having a base and a shroud that extends from the base. The shroud includes a tunnel. The tunnel extends a length from a first open end to a second open end. The base is configured to be mounted to a wearable article. The connector system includes a first connector having a first group of terminals, and a second connector having a second group of terminals. The second connector is configured to mate with the first connector such that the second group of terminals is mated with the first group of terminals. The first and second connectors are configured to be received into the tunnel of the holder through the first and second open ends, respectively, of the tunnel such that the first and second connectors mate together within the tunnel.

DETAILED DESCRIPTION OF THE INVENTION

Figure 1:
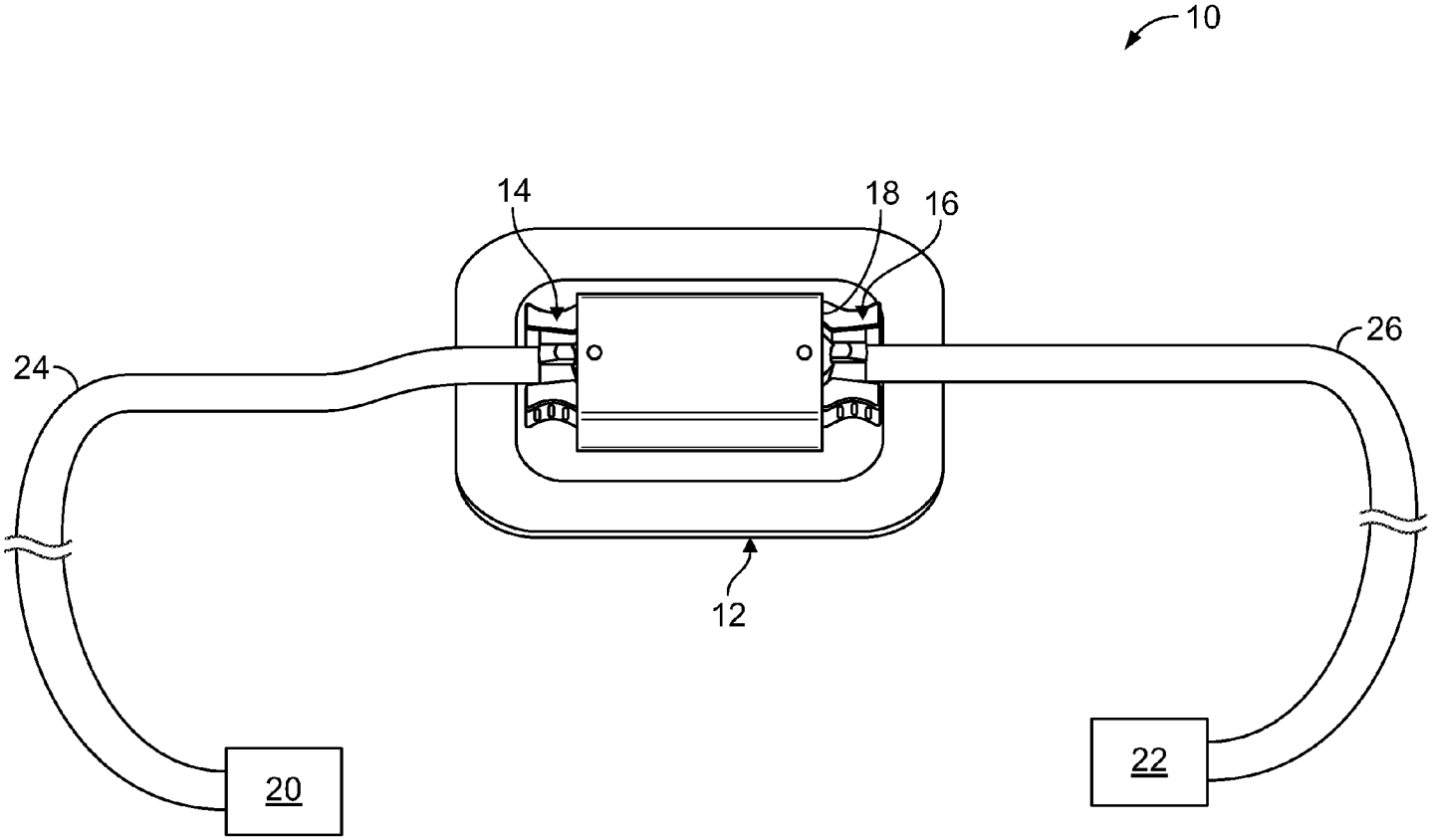
FIG. 1 is a perspective view of an embodiment of an electrical connector system.
Figure 2:
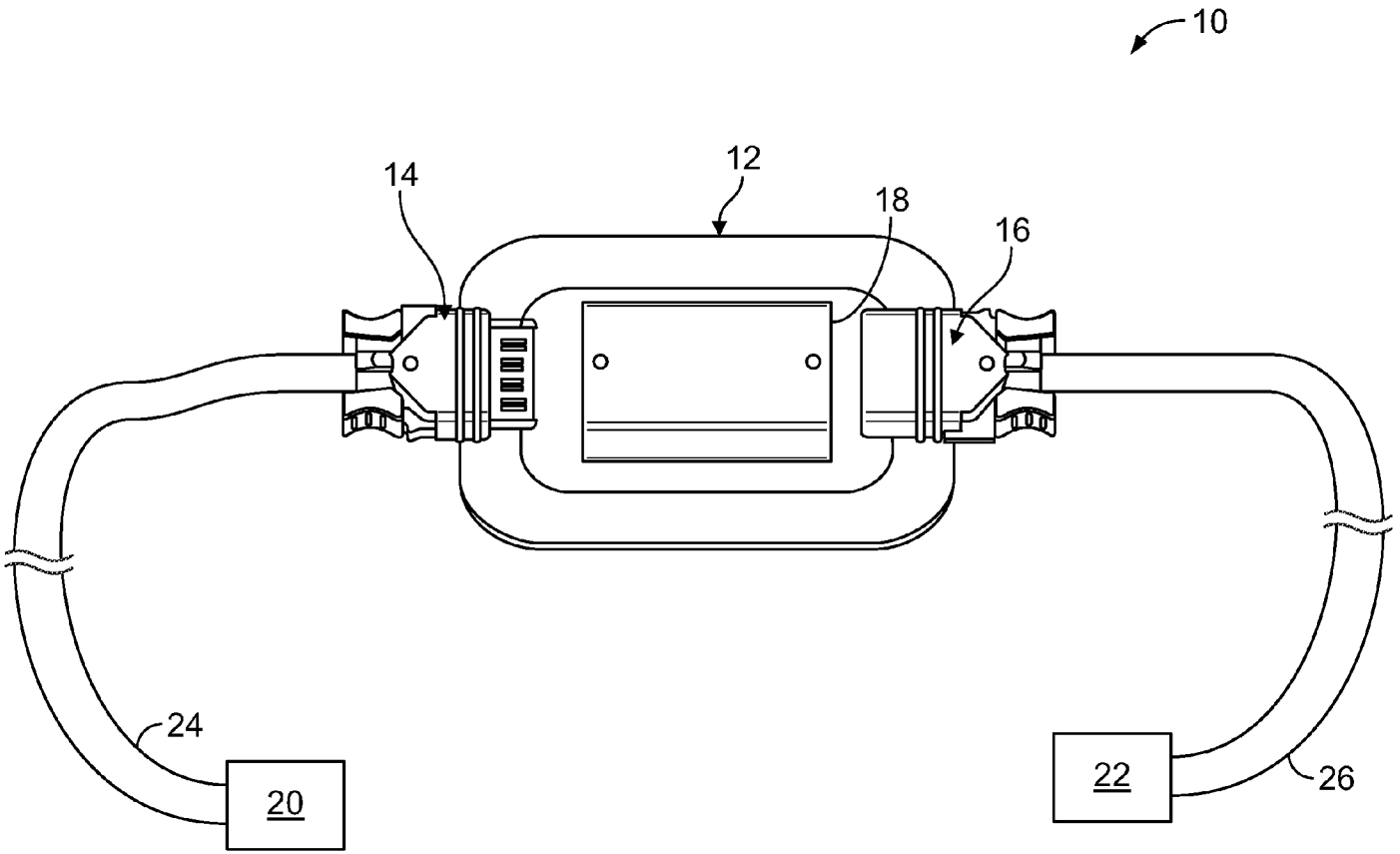
FIG. 2 is a partially exploded view of the electrical connector system shown in FIG. 1.

FIG. 1 is a perspective view of an embodiment of an electrical connector system 10. FIG. 2 is a partially exploded perspective view of the electrical connector system 10. The electrical connector system 10 includes a holder 12 and electrical connectors 14 and 16 that mate together within a tunnel 18 of the holder 12 to form an electrical connection therebetween. The electrical connector system 10 is provided along an electrical path between two electronic devices 20 and 22 for providing a separable electrical connection between the electronic devices 20 and 22. As will be described below, the electrical connector system 10 is optionally mounted to a wearable article (not shown), such as, but not limited to, a vest, a shirt, a jacket, pants, trousers, a boot, a shoe, a helmet, a hat, a cap, a coat, armor, and/or the like. Each of the electrical connectors 14 and 16 may be referred to herein as a "mating connector", a "first" connector, and/or a "second" connector.

Each of the devices 20 and 22 may be any type of electronic device. In an exemplary embodiment, the electronic device 20 constitutes a battery pack and the electronic device 22 constitutes an LED array that may be powered by the battery pack. Other types of electronic devices may be interconnected by the electrical connector system 10 in other embodiments.

In the illustrated embodiment, the electrical connector 14 is electrically connected to the electronic device 20 via a cable 24. The cable 24 may have any length. In other words, the electrical connector 14 terminates the electrical cable 24. In alternative to the cable 24, the electrical connector 14 may be mounted directly to the electronic device 20 or may be electrically connected to the electronic device 20 via an e-textile (not shown) that includes fabrics that enable computing, digital components, electrical pathways, electronic devices, and/or the like to be embedded therein. Specifically, the e-textile provides a wearable article with wearable technology that allows for the incorporation of built-in technological elements into the fabric of the wearable article. The wearable article may constitute intelligent (i.e., smart) clothing.

The electrical connector 16 is also shown in the illustrated embodiment as being electrically connected to the corresponding electronic device 22 via a corresponding cable 26. But, in other embodiments, the electrical connector 16 may be mounted directly to the electronic device 22 or may be electrically connected to the electronic device 22 via the electrical conductors (not shown) of an e-textile (not shown).

Figure 3:
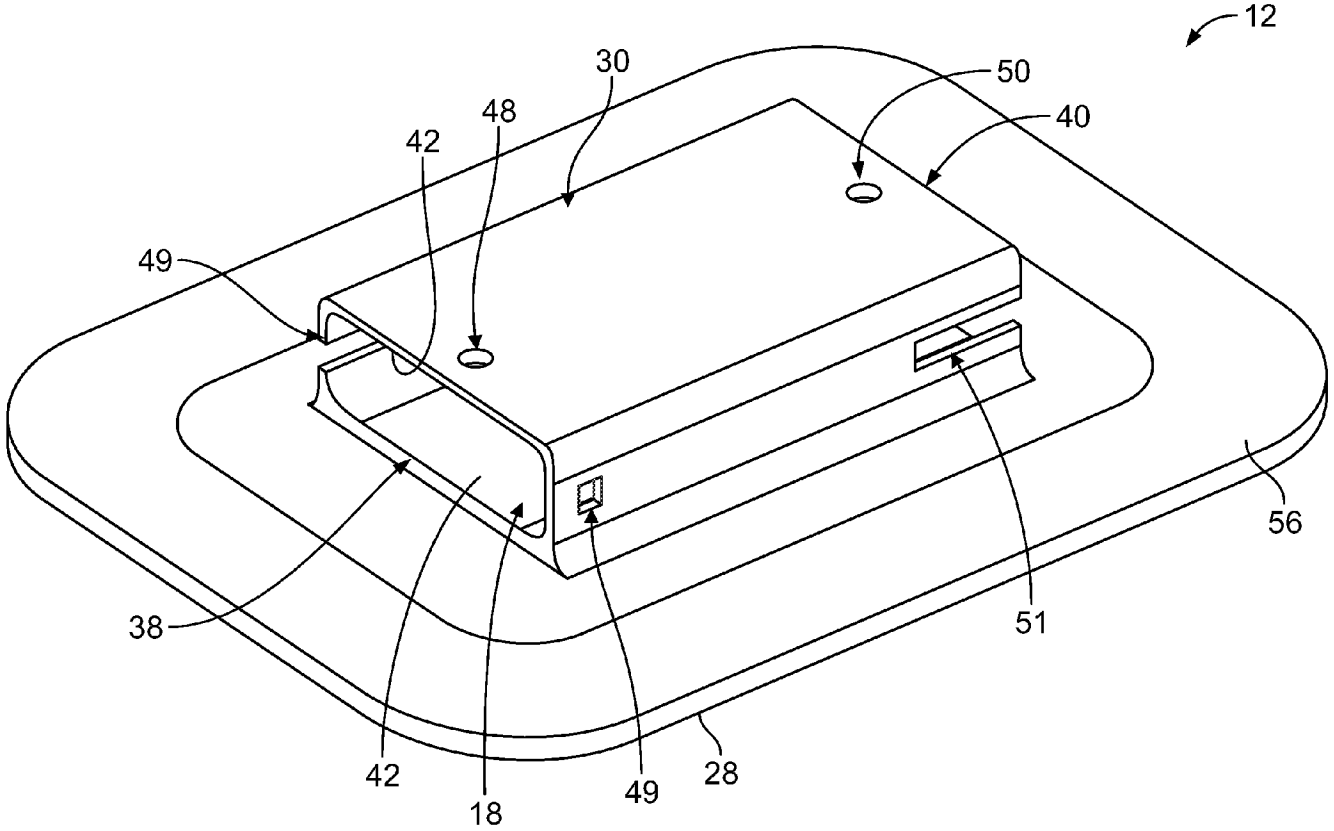
FIG. 3 is a perspective view of an embodiment of a holder of the electrical connector system shown in FIGS. 1 and 2.

FIG. 3 is a perspective view of an embodiment of the holder 12 of the electrical connector system 10. As discussed above, the electrical connector system 10 is optionally held by a wearable article. Optionally, the holder 12 is mounted to a wearable article to mount the electrical connector system 10 to the wearable article. In other words, in embodiments wherein the electrical connector system 10 is held by a wearable article, the holder 12 is optionally used to mount the system 10 to the wearable article.

The holder 12 includes a base 28 and a shroud 30 that extends from the base 28. The shroud 30 includes a tunnel 18 of the holder 12. The tunnel 18 extends a length from an open end 38 to an opposite open end 40. The tunnel 18 is open at each of the open ends 38 and 40 (as opposed to being closed off at the ends 38 and 40) such that each of the open ends 38 and 40 provides an entrance to the tunnel 18. Each of the open ends 38 and 40 may be referred to herein as a "first" and/or a "second" open end.

The tunnel 18 of the holder 12 includes an interior surface 42 that extends along the length of the tunnel 18. As will be described below, the interior surface 42 of the tunnel 18 is configured to sealingly engage in physical contact with a sealing member 44 (FIGS. 4 and 6) of the electrical connector 14 and/or with a sealing member 46 (FIGS. 5 and 6) of the electrical connector 16 to seal the tunnel 18. In the illustrated embodiment, the base 28 is closed along an approximately entirety of the length and width of the tunnel 18 such that the base 28 defines a continuous boundary of the tunnel 18 along an approximate entirety of the length and width of the tunnel 18. But, the base 28 alternatively includes one or more openings (not shown) that extend through the base 28 along width and/or length of the tunnel 18. The sealing member 44 may be referred to herein as a "first" and/or a "second" sealing member.

As briefly described above, the electrical connectors 14 and 16 mate together within the tunnel 18 of the holder 12. As will be described below, the electrical connectors 14 and 16 configured to be received into the tunnel 18 through the open ends 38 and 40, both respectively and vice versa.

The holder 12 optionally includes one or more latch features 48 and/or 50 that cooperate with a latch feature 52 (FIGS. 4 and 6) of the electrical connector 14 (FIGS. 1, 2, 4, and 6) to hold the electrical connector 14 within the tunnel 18. The latch features 48 and 50 are also each configured to cooperate with a latch feature 54 (FIGS. 5 and 6) of the electrical connector 16 (FIGS. 1, 2, 5, and 6) to hold the electrical connector 16 within the tunnel 18. The latch features 48 and/or 50 may also facilitate holding the electrical connectors 14 and 16 as mated together within the tunnel 18. In the illustrated embodiment, each latch feature 48 and 50 is an opening that receives an embossment of the latch feature 52 and 54 therein with a snap-fit connection. But, each latch feature 48 and 50 may be any other type of latch feature that facilitates holding the electrical connectors 14 and/or 16 within the tunnel 18. Although shown as being located on the shroud 30, additionally or alternatively the latch features 48 and/or 50 may be located on the base 28.

In addition or alternative to the latch features 48 and/or 50, the holder 12 may include one or more other latch features 49 and/or 51 for holding the electrical connectors 14 and/or 16 within the tunnel 18. The latch features 49 and 51 are each configured to cooperate with a latch feature 53 (FIGS. 4 and 6) of the electrical connector 14 to hold the electrical connector 14 within the tunnel 18. The latch features 49 and 51 are also each configured to cooperate with a latch feature 55 (FIGS. 5 and 6) of the electrical connector 14 to hold the electrical connector 16 within the tunnel 18. The latch features 49 and/or 51 may also facilitate holding the electrical connectors 14 and 16 as mated together within the tunnel 18. In the illustrated embodiment, each latch feature 49 and 51 includes two openings that are configured to receive corresponding squeeze latch members 53*a* and 53*b* (FIGS. 4 and 6) of the latch feature 53 and are configured to receive corresponding squeeze latch members 55*a* and 55*b* (FIGS. 5 and 6) of the latch feature 55 therein. But, each latch feature 49 and 51 may be any other type of latch feature that facilitates holding the electrical connectors 14 and/or 16 within the tunnel 18. Although shown as being located on the shroud 30, additionally or alternatively the latch features 49 and/or 51 may be located on the base 28. Only one of the openings of the latch feature 51 is visible in FIG. 3.

As described above, the holder 12 may be mounted to the wearable article to thereby mount the electrical connector system 12 to the wearable article. The holder 12 may be mounted to the wearable article using any type of connection, such as, but not limited to, by being sewn to the wearable article, by being adhered to the wearable article using an adhesive, and/or the like. In the illustrated embodiment, the base 28 of the holder 12 includes a flange 56 through which a thread may be routed to sew the holder 12 to the wearable article. Optionally, the holder 12 may be mounted to the wearable article within and/or under a pocket and/or other covering of the wearable article. For example, a flap and/or one or more other segments of the wearable article may cover at least a portion of the holder 12, the connector 14, the connector 16, the cable 24, and/or the cable 26.

Each of the base 28 and the shroud 30 of the holder 12 may be fabricated from any material(s) having any material properties that enable the holder 12 to function as described and/or illustrated herein, such as, but not limited to, a plastic, a polymer, a composite material, an elastomer, a thermoplastic, a thermoset, a natural material, and/or the like. Optionally, the base 28 of the holder 12 is fabricated from one or more different materials than the shroud 30. For example, the shroud 30 may be fabricated from one or more different materials than the base 28 to provide the shroud 28 with more rigidity and/or more hardness as compared to the base 30. The shroud 30 may be provided with a rigidity and/or hardness that facilitates latching to the electrical connectors 14 and/or 16 (e.g., using the latch features 48 and/or 50 described above) and/or that facilitates sealing with the electrical connectors 14 and/or 16 (e.g., using the sealing members 44 and/or 46 described below with reference to FIGS. 4 and 5, respectively.)

The open-ended structure of the tunnel 18 may provide enable the tunnel 18 to be cleaned. For example, a user may use their thumb, a cloth, a rod, and/or the like to remove debris, dirt, other contaminants, and/or the like from inside the tunnel 18 and along the interior surface 42 of the tunnel 18. Moreover, the open-ended structure of the tunnel 18 may trap less dirt, debris, other contaminants, and/or the like than the mating interfaces of at least some known electrical connectors. The open-ended structure of the tunnel 18 may enable the terminals 62 (FIG. 4) of the electrical connector 14 to be more reliable mated with the terminals 76 (FIG. 5) of the electrical connector 16, for example as compared to at least some known electrical connector systems.

Figure 4:
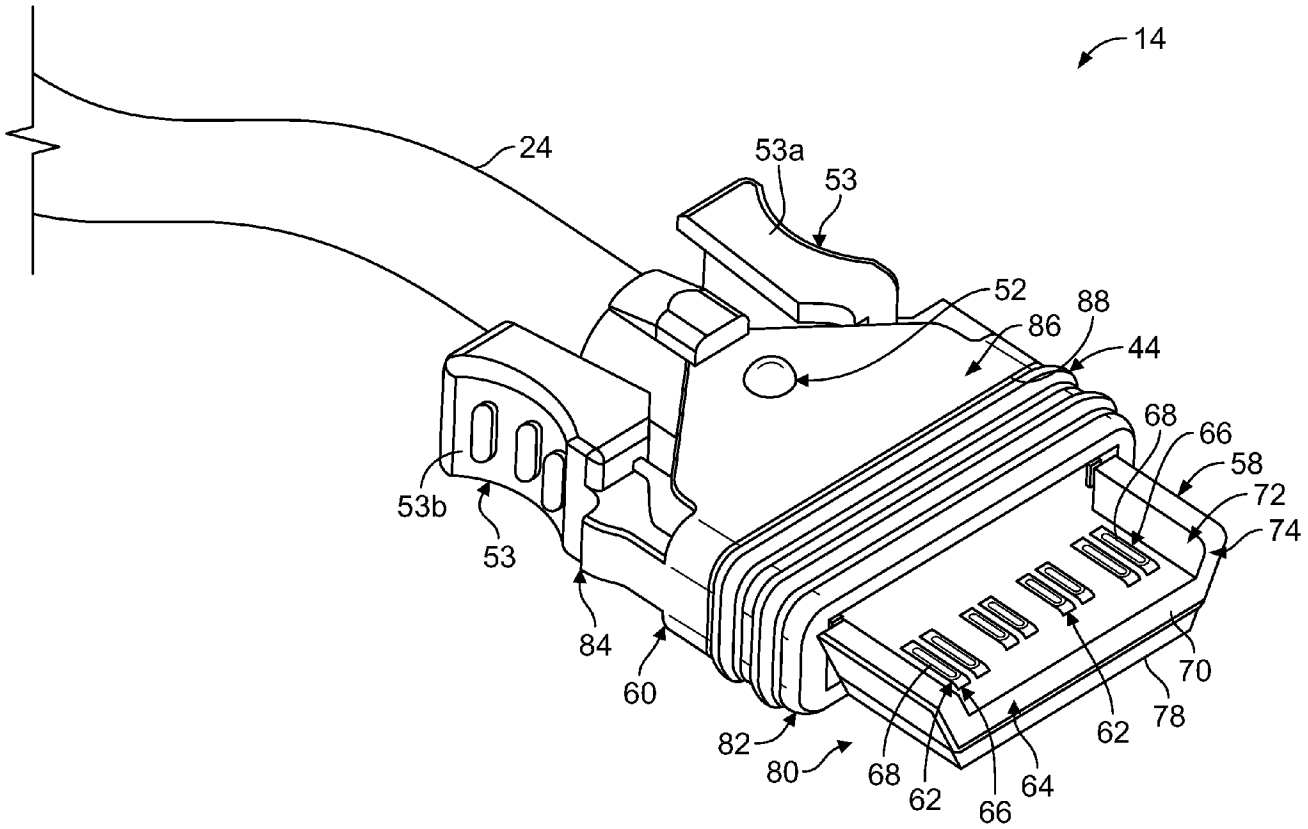
FIG. 4 is a perspective view of an embodiment of an electrical connector of the electrical connector system shown in FIGS. 1 and 2.

FIG. 4 is a perspective view of an embodiment of the electrical connector 14. The electrical connector 14 includes a terminal subassembly 58 and a housing 60 that holds the terminal subassembly 58. The terminal subassembly 58 has a plurality of terminals 62 that are electrically connected to corresponding electrical conductors (not shown) of the cable 24, which is also shown in FIG. 4. The terminal subassembly 58 may include an insulator 64 that holds the terminals 62. The insulator 64 may provide impedance control, such as by positioning the terminals 62 at predetermined locations to achieve a target characteristic impedance.

The terminals 62 include mating ends 66. The mating ends 66 have mating surfaces 68 configured for mating with the electrical connector 16 (FIGS. 1, 2, 5, and 6). Each of the terminals 62 may be a signal terminal, a ground terminal, or a power terminal. Although eight are shown, the electrical connector 14 may include any number of the terminals 62. Optionally, four of the terminals 62 may be configured to operate at any universal serial bus (USB) standard, protocol, and/or the like, such as, but not limited to, USB 1.0, USB 2.0, USB 3.0, and/or the like. The terminals 62 may be referred to herein as a "first" and/or a "second" group of terminals.

The insulator 64 includes a platform 70 that has a terminal side 72. The mating ends 66 of the terminals 62 are arranged along the platform 70. Specifically, the mating ends 66 of the terminals 62 are positioned on the terminal side 72 of the platform 70 such that the mating surfaces 68 are arranged along the terminal side 72 of the platform 70. The mating ends 66 of the terminals 62 rest on the terminal side 72 of the platform 70 such that the terminal side 72 supports the mating ends 66 of the terminals 62.

The mating surfaces 68 of the mating ends 66 of the terminals 62 define a mating interface 74 of the electrical connector 14 where the mating surfaces 68 mate with corresponding terminals 76 (FIG. 5) of the electrical connector 16. As described above, the mating ends 66 of the terminals 62 are arranged along the terminal side 72 of the platform 70. Accordingly, the mating interface 74 of the electrical connector 14 extends on the terminal side 72 of the platform 70.

The terminal subassembly 58 optionally includes an electrically conductive shield 78 that extends at least partially around the terminals 62. The shield 78 provides electrical shielding to the terminals 62, which may prevent or reduce electromagnetic interference (EMI) and/or radio frequency interference (RFI) on signal paths defined through the electrical connector 14. Electrical shielding provided by the shield 78 may allow relatively high speed data to be uninterrupted by the electrical connector 14. The shield 78 is optionally electrically connected to a ground conductor (not shown) of the cable 24.

The mating interface 74 of the electrical connector 14 is optionally approximately flat. For example, in the illustrated embodiment, the mating surface 68 of each of the terminals 62 is approximately flat. Specifically, the mating ends 66, and thus the mating surfaces 68, of the terminals 62 are arranged side by side in a row 80. The mating surfaces 68 of the terminals 62 extend approximately within the same plane. The approximately flat shapes of the mating surfaces 68 and the alignment within the common plane provides the mating interface 74 of the electrical connector 14 as approximately flat.

Optionally, the terminal side 72 of the platform 70 includes grooves (not shown) that receive the mating ends 66 of corresponding terminals 62 therein. The mating surfaces 68 of the terminals 62 may be offset above the terminal side 72 of the platform 70 or may be flush (i.e., coplanar) with the terminal side 72. For example, in the illustrated embodiment, the mating surfaces 68 are offset above segments of the terminal side 72 that extend between the mating ends 66 of the terminals 62. The grooves and terminals 62 have a relative size that is selected to provide the offset with a predetermined value. In other embodiments, the terminal side 72 of the platform 70 does not include the grooves and the thickness of the mating ends 66 of the terminals 62 is selected to provide the offset with a predetermined value. The offset may have any value. As discussed above, in some alternative embodiments, the grooves and the terminals 62 have a relative size that is selected such that the mating surfaces 68 of the terminals 62 are flush (i.e., coplanar) with the terminal side 72 of the platform. In other words, the offset may have a value of approximately zero in some embodiments.

In the illustrated embodiment, the mating interface 74 of the electrical connector 14 is exposed when the connector 14 is not mated with the electrical connector 16. Specifically, the platform 70 of the insulator 64 extends outward from an end 82 of the housing 60 such that the terminal side 72 of the platform 70 is exposed from (i.e., not covered by) the housing 60. Moreover, the terminal side 72 of the platform 70 is exposed from (i.e., not covered by) the shield 78. The mating ends 66 of the terminals 62 extend along the terminal side 72 of the platform 70 such that the mating interface 74 of the electrical connector 14 is exposed from the housing 60 and is exposed from the shield 78.

The approximately flat structure and/or the exposure of the mating interface 74 of the electrical connector 14 may provide a wipeable and/or cleanable surface for cleaning the mating surfaces 68 of the terminals 62. For example, a user may use their thumb, a cloth, and/or the like to wipe across the mating interface 74 to clear debris, dirt, other contaminants, and/or the like from the terminals 62. Moreover, the approximately flat structure and/or the exposure of the mating interface 74 may trap less dirt, debris, other contaminants, and/or the like than the mating interfaces of at least some known electrical connectors. The approximately flat structure and/or the exposure of the mating interface 74 may thus enable the mating surfaces 68 of the terminals 62 to be more reliable and/or be more easily cleaned than the terminals of at least some known electrical connectors. For example, the approximately flat structure and/or the exposure of the mating interface 74 may enable the mating surfaces 68 of the terminals 62 to be cleaned without damaging the terminals 62.

The housing 60 may include the latch feature 52, which as described above cooperates with either of the latch features 48 and 50 (FIGS. 3 and 6) of the holder 12 (FIGS. 1-3 and 6) to hold the electrical connector 14 within the tunnel 18 (FIGS. 3 and 6) of the holder 12. The latch feature 52 may also facilitate holding the electrical connectors 14 and 16 as mated together within the tunnel 18. In the illustrated embodiment, the latch feature 52 is an embossment, but the latch feature 52 may be any other type of latch feature that facilitates holding the electrical connector 14 within the tunnel 18. Moreover, in some embodiments, the latch feature 52 includes an opening that is configured to receive an embossment of the latch feature 48 and/or an embossment of the latch feature 50.

The housing 60 may include the latch feature 53. As described above, the latch feature 53 cooperates with either of the latch features 49 and 51 (FIGS. 3 and 6) of the holder 12 to hold the electrical connector 14 within the tunnel 18. The latch feature 53 may also facilitate holding the electrical connectors 14 and 16 as mated together within the tunnel 18. In the illustrated embodiment, the latch feature 53 is a squeeze latch having squeeze latch members 53*a* and 53*b* that may be squeezed together and released to move projections 84 (only one of which is visible in FIG. 4) of the members 53*a* and 53*b* into and out of, respectively, the corresponding openings of the latch feature 49 and the corresponding openings of the latch feature 51. But, the latch feature 53 may be any other type of latch feature that facilitates holding the electrical connector 14 within the tunnel 18.

The electrical connector 14 optionally includes the sealing member 44. The sealing member 44 extends around the housing 60. Specifically, the sealing member 44 extends along an exterior side 86 of the housing 60. As will be described below, the sealing member 44 is configured to sealingly engage in physical contact with the interior surface 42 (FIGS. 3 and 6) of the tunnel 18 of the holder 12 to facilitate sealing the tunnel 18. The sealing member 44 may have any size, shape, materials, structure, and/or the like that enables the sealing member 44 to form a seal with the tunnel 18 (i.e., sealingly engage in physical contact with the interior surface 42 of the tunnel 18. Optionally, the sealing member 44 is elastomeric. The housing 60 optionally includes one or more grooves 88 that holds the sealing member 44 therein.

Figure 5:
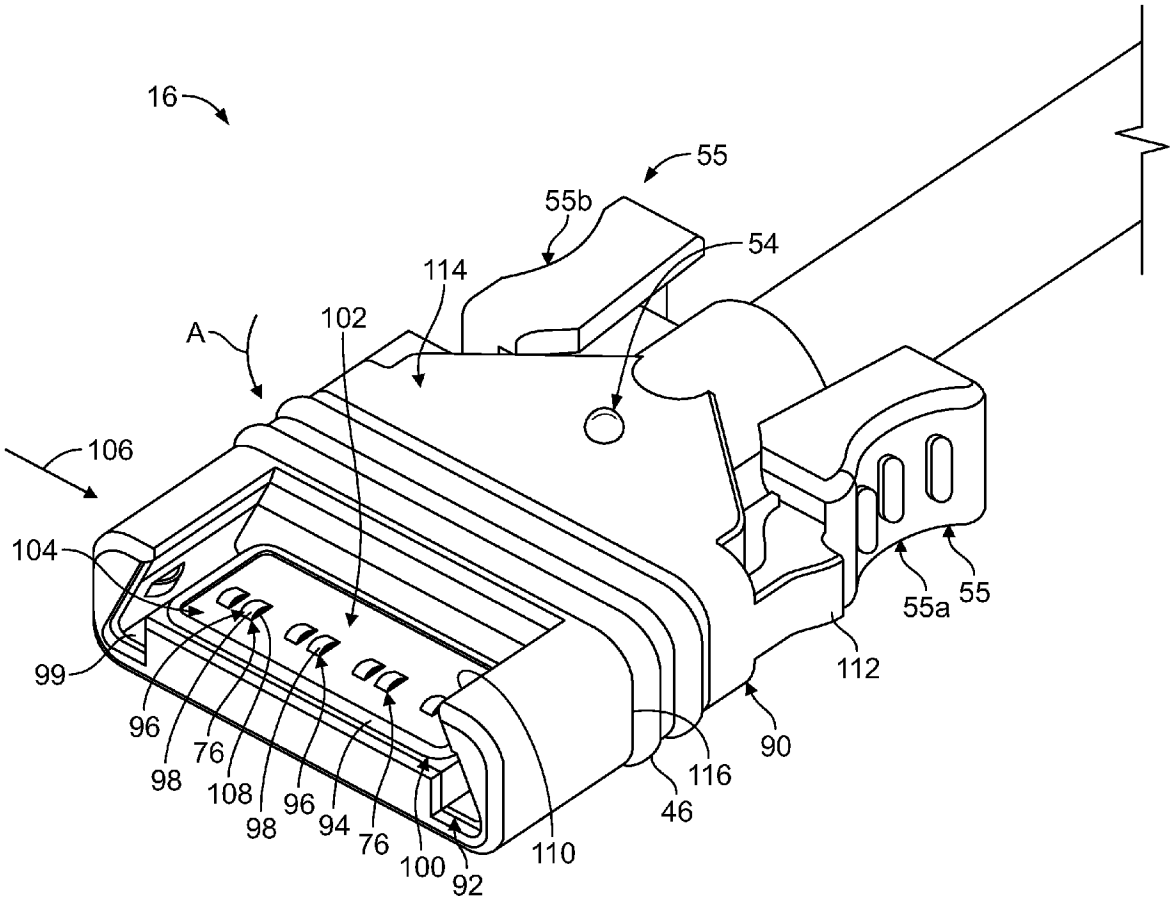
FIG. 5 is a perspective view of an embodiment of another electrical connector of the electrical connector system shown in FIGS. 1 and 2.

FIG. 5 is a perspective view of an embodiment of the electrical connector 16. The electrical connector 16 includes a housing 90 and a terminal subassembly 92 that is held by the housing 90. The terminal subassembly 92 includes the terminals 76, which are electrically connected to corresponding electrical conductors (not shown) of the cable 26 (also shown in FIG. 5). The terminal subassembly 92 may include an insulator 94 that holds the terminals 76. The insulator 94 may provide impedance control, such as by positioning the terminals 76 at predetermined locations to achieve a target characteristic impedance.

The terminals 76 include mating ends 96. The mating ends 96 have mating surfaces 98 configured for mating with the electrical connector 14 (FIGS. 1, 2, 4, and 6). Each of the terminals 76 may be a signal terminal, a ground terminal, or a power terminal. Although eight are shown, the electrical connector 16 may include any number of the terminals 76. Four of the terminals 76 are optionally configured to operate at any USB standard, protocol, and/or the like, such as, but not limited to, USB 1.0, USB 2.0, USB 3.0, and/or the like. The terminals 76 may be referred to herein as a "first" and/or a "second" group of terminals.

The insulator 94 includes a platform 100 that has a terminal side 102 along which the mating ends 96 of the terminals 76 are arranged. Specifically, the mating ends 96 of the terminals 76 are positioned on the terminal side 102 of the platform 100 such that the mating surfaces 98 are arranged along the terminal side 102. The mating surfaces 98 of the terminals 76 define a mating interface 104 of the electrical connector 16. The mating surfaces 98 mate with the corresponding terminals 62 (FIG. 4) of the electrical connector 14 at the mating interface 104. The mating interface 104 of the electrical connector 16 extends on the terminal side 102 of the platform 100. In the illustrated embodiment, the mating ends 96 of the terminals 76 are deflectable springs that are configured to deflect generally in the direction of the arrow A when mated with the terminals 62 of the electrical connector 14. Alternatively, the mating ends 96 have a different structure.

The terminal subassembly 92 optionally includes an electrically conductive shield 99 that extends at least partially around the terminals 76. The shield 99 provides electrical shielding to the terminals 76, which may prevent or reduce EMI and/or RFI on signal paths defined through the electrical connector 16. Electrical shielding provided by the shield 99 may allow relatively high speed data to be uninterrupted by the electrical connector 16. The shield 99 is optionally electrically connected to a ground conductor (not shown) of the cable 26.

As can be seen in FIG. 5, the mating ends 96 of the terminals 76 extend within corresponding grooves 108 of the insulator 94. The mating ends 96 are configured to be deflected into or further into the corresponding grooves 108 when the mating ends 96 are mated with the terminals 62 of the electrical connector 14. The terminal side 102 of the platform 100 of the insulator 94 is configured to protect the mating ends 96 of the terminals 76 from over-deflection. Specifically, the terminals side 102 of the platform 100 is aligned with a predetermined deflected position of the mating ends 96 that represents a maximum desired deflection of the mating ends 96. Accordingly, as a structure (e.g., the electrical connector 14) engages the mating ends 96 of the terminals 76, the structure will engage the terminal side 102 of the platform 100 such that the structure cannot move the mating surfaces 98 of the mating ends 96 past the terminal side 102. The terminal side 102 thus prevents the mating ends 96 from being deflected to or past a position where the mating ends 86 are damaged from being deflected past the working range of the mating ends 96.

The mating interface 104 of the electrical connector 16 is optionally approximately flat. For example, the mating surface 98 of each of the terminals 76 is approximately flat, at least once the mating end 96 is deflected after being mated with the corresponding terminal 62. Specifically, the mating ends 96, and thus the mating surfaces 98, of the terminals 76 are arranged side by side in a row 106. The mating surfaces 98 of the terminals 76 extend approximately within the same plane. The approximately flat shapes of the mating surfaces 98 and the alignment within the common plane provides the mating interface 104 of the electrical connector 16 as approximately flat, at least once the mating ends 96 have been deflected after being mated with the corresponding terminals 62.

In the illustrated embodiment, and as can be seen in FIG. 5, the mating interface 104 of the electrical connector 16 is exposed when the connector 16 is not mated with the electrical connector 14. Specifically, the terminal side 102 of the platform 100 of the insulator 94 is exposed from (i.e., not covered by) the housing 90 through an opening 110 of the housing 90. Moreover, the terminal side 102 of the platform 100 is exposed from (i.e., not covered by) the shield 99. The mating ends 96 of the terminals 76 extend along the terminal side 102 of the platform 100 such that the mating interface 104 of the electrical connector 16 is exposed from the housing 90 and is exposed from the shield 99. As can be seen in FIG. 5, the opening 110 of the housing 90 is configured to receive (e.g., is sized and shaped complementary with) the terminal subassembly 58 (FIG. 4) of the electrical connector 14.

The approximately flat structure and/or the exposure of the mating interface 104 of the electrical connector 16 may provide a wipeable and/or cleanable surface for cleaning the mating surfaces 98 of the terminals 76. For example, a user may use their thumb, a cloth, and/or the like to wipe across the mating interface 104 to clear debris, dirt, other contaminants, and/or the like from the terminals 76. Moreover, the approximately flat structure and/or the exposure of the mating interface 104 may trap less dirt, debris, other contaminants, and/or the like than the mating interfaces of at least some known electrical connectors. The approximately flat structure and/or the exposure of the mating interface 104 may thus enable the mating surfaces 98 of the terminals 76 to be more reliable and/or be more easily cleaned than the terminals of at least some known electrical connectors. For example, the approximately flat structure and/or the exposure of the mating interface 104 may enable the mating surfaces 98 of the terminals 76 to be cleaned without damaging the terminals 76.

The housing 90 may include the latch feature 54, which as described above cooperates with either of the latch features 48 and 50 (FIGS. 3 and 6) of the holder 12 (FIGS. 1-3 and 6) to hold the electrical connector 16 within the tunnel 18 (FIGS. 3 and 6) of the holder 12. The latch feature 54 may also facilitate holding the electrical connectors 14 and 16 as mated together within the tunnel 18. In the illustrated embodiment, the latch feature 54 is an embossment, but the latch feature 54 may be any other type of latch feature that facilitates holding the electrical connector 16 within the tunnel 18. Moreover, in some embodiments, the latch feature 54 includes an opening that is configured to receive an embossment of the latch feature 48 and/or an embossment of the latch feature 50.

The housing 90 may include the latch feature 55. As described above, the latch feature 55 cooperates with either of the latch features 49 and 51 (FIGS. 3 and 6) of the holder 12 to hold the electrical connector 16 within the tunnel 18. The latch feature 55 may also facilitate holding the electrical connectors 14 and 16 as mated together within the tunnel 18. In the illustrated embodiment, the latch feature 55 is a squeeze latch having squeeze latch members **55*a* and 55*b* that may be squeezed together and released to move projections 112 (only one of which is visible in FIG. 5) of the members 55*a* and 55*b* into and out of, respectively, the corresponding openings of the latch feature 49 and the corresponding openings of the latch feature 51. But, the latch feature 55 may be any other type of latch feature that facilitates holding the electrical connector 16 within the tunnel 18**.

The electrical connector 16 optionally includes the sealing member 46, which extends around the housing 90. Specifically, the sealing member 46 extends along an exterior side 114 of the housing 90. As will be described below, the sealing member 46 is configured to sealingly engage in physical contact with the interior surface 42 (FIGS. 3 and 6) of the tunnel 18 of the holder 12 to facilitate sealing the tunnel 18. The sealing member 46 may have any size, shape, materials, structure, and/or the like that enables the sealing member 46 to form a seal with the tunnel 18 (i.e., sealingly engage in physical contact with the interior surface 42 of the tunnel 18). Optionally, the sealing member 46 is elastomeric. The housing 90 optionally includes one or more grooves 116 that holds the sealing member 46 therein. The sealing member 46 may be referred to herein as a "first" and/or a "second" sealing member.

Figure 6:
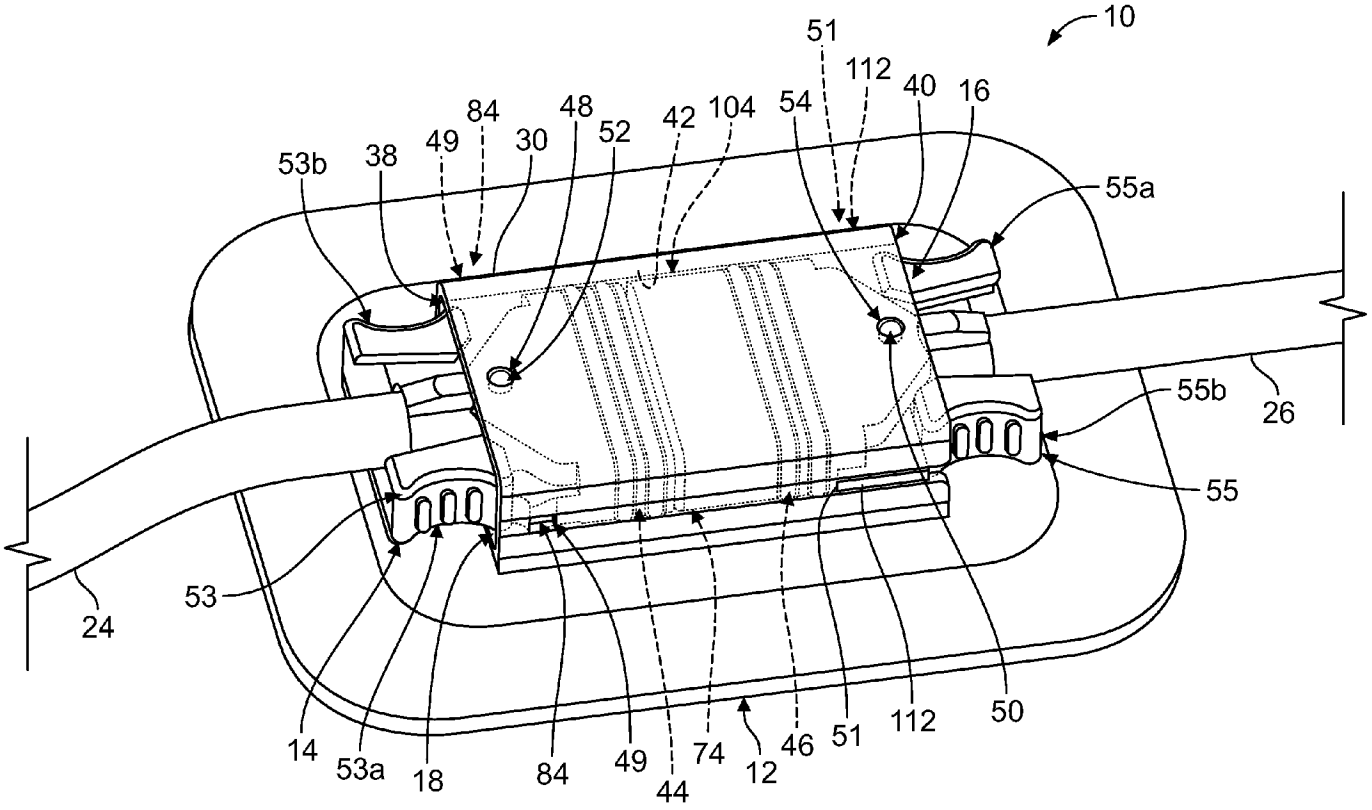
FIG. 6 is a perspective view of the electrical connector system shown in FIGS. 1 and 2 illustrating the electrical connectors shown in FIGS. 4 and 5 as mated together within the holder shown in FIG. 3.

FIG. 6 is a perspective view of the electrical connector system 10 illustrating the electrical connectors 14 and 16 as mated together within the tunnel 18 of the holder 12. The shroud 30 of the holder 12 is shown in phantom in FIG. 6 to better illustrate the mating of the electrical connectors 14 and 16. To mate the electrical connectors 14 and 16 together within the tunnel 18, the connectors 14 and 16 are inserted into the tunnel 18 through the open ends 38 and 40. In the illustrated embodiment, the electrical connector 14 is received (i.e., inserted) into the tunnel 18 through the open end 38, and the electrical connector 16 is received into the tunnel 18 through the open end 40.

As shown in FIG. 6, the electrical connectors 14 and 16 have been received into the tunnel 18 such that the connectors 14 and 16 are mated together within the tunnel 18. Specifically, the electrical connectors 14 and 16 are mated together at the respective mating interfaces 74 and 104 such that the mating surfaces 68 (FIG. 4) of the terminals 62 (FIG. 4) of the electrical connector 14 are engaged in physical contact with, and thereby electrically connected to, the mating surfaces 98 (FIG. 5) of the terminals 76 (FIG. 5) of the electrical connector 16. The electrical connectors 14 and 16 are thus mated together within the tunnel 18 to establish an electrical connection between the electrical connectors 14 and 16, and thus between the cables 24 and 26. The electrical connectors 14 and 16 may be considered "blind mate" connectors because the mating interfaces 74 and 104 are not visible (i.e., are obscured by the shroud 30) as the electrical connectors 14 and 16 are mated together within the tunnel 18.

Although the electrical connectors 14 and 16 have been received into the tunnel 18 through the respective open ends 38 and 40 in the illustrated embodiment, as briefly described above, each of the electrical connectors 14 and 16 is configured to be selectively received into the tunnel 18 through both the open end 38 and the open end 40. Accordingly, the electrical connectors 14 and 16 may be mated together within the tunnel 18 by inserting the electrical connector 14 into the open end 40 and inserting the electrical connector 16 into the open end 38.

The latch feature 52 of the electrical connector 14 cooperates with the latch feature 48 of the holder 12 to facilitate holding the electrical connector 14 within the tunnel 18 and/or to facilitate holding the electrical connectors 14 and 16 as mated together within the tunnel 18. Specifically, and as shown in FIG. 6, the embossment of the latch feature 52 is received within the opening of the latch feature 48. Similarly, the embossment of the latch feature 54 of the electrical connector 16 is received within the opening of the latch feature 50 of the holder 12 to facilitate holding the electrical connector 14 within the tunnel 18 and/or to facilitate holding the electrical connectors 14 and 16 as mated together within the tunnel 18.

The latch feature 53 of the electrical connector 14 cooperates with the latch feature 49 of the holder 12 to facilitate holding the electrical connector 14 within the tunnel 18 and/or to facilitate holding the electrical connectors 14 and 16 as mated together within the tunnel 18. Specifically, the projections 84 of the squeeze latch members 53*a* and 53*b* of the latch feature 53 are received within the corresponding openings of the latch feature 49. As is also shown in FIG. 6, the projections 112 of the squeeze latch members 55*a* and 55*b* of the latch feature 55 of the electrical connector 16 are received within the corresponding openings of the latch feature 51 of the holder 12 to facilitate holding the electrical connector 16 within the tunnel 18 and/or to facilitate holding the electrical connectors 14 and 16 as mated together within the tunnel 18.

As shown in FIG. 6, the sealing member 44 of the electrical connector 14 is sealingly engaged in physical contact with the interior surface 42 of the tunnel 18. In the illustrated embodiment, the seal created by the sealing engagement between the sealing member 44 and the interior surface 42 seals the open end 38 of the tunnel 18. For example, the seal provided by the sealing member 44 may provide the open end 38 of the tunnel 18 as liquid and/or moisture tight (e.g., water tight). The liquid and/or moisture may be any type (i.e., may be formed of any substance(s)) of liquid and/or moisture, such as, but not limited to, water, a corrosive liquid, an acidic liquid, humidity, dew, and/or the like. By "liquid and/or moisture tight", it is meant that one or more particular types of liquids and/or one or more particular types moistures cannot pass the seal created by the sealing engagement between the sealing member and the interior surface 42 of the tunnel 18.

As can also be seen in FIG. 6, the sealing member 46 of the electrical connector 16 is sealingly engaged in physical contact with the interior surface 42 of the tunnel 18. The seal created by the sealing engagement between the sealing member 46 and the interior surface 42 seals the open end 40 of the tunnel 18 in the illustrated embodiment. The seal provided by the sealing member 46 may provide the open end 40 of the tunnel 18 as liquid and/or moisture tight (e.g., water tight). Moreover, FIG. 6 illustrates that the mating interfaces 74 and 104 of the electrical connectors 14 and 16, respectively, extend between the sealing members 44 and 46 along the length of the tunnel 18 when the electrical connectors 14 and 16 are mated together within the tunnel 18. The mating interfaces 74 and 104 thus extend between the seals provided by the sealing members 44 and 46 when the electrical connectors 14 and 16 are mated together within the tunnel 18. The seals provided by the sealing members 44 and 46 may provide the mated interface between the electrical connectors 14 and 16 within the tunnel 18 as liquid and/or moisture tight. The seals provided by the sealing members 44 and 46 may protect the electrical connectors 14 and 16 from damage caused by exposure to liquid and/or moisture, such that exposure to liquid and/or moisture does not interfere with operation of the electrical connector system 10. The seals provided by the sealing members 44 and 46 may enable the electrical connector system 10 to be used in environments wherein the electrical connector system 10 is exposed to a liquid and/or moisture. For example, the seals provided by the sealing members 44 and 46 may enable the electrical connector system 10 to be used in environments wherein the electrical connector system 10 is at least partially submerged (i.e., immersed) in a liquid (e.g., water and/or the like).

Optionally, the electrical connectors 14 and 16 are open interface connectors. As used herein, an "open interface connector" is a connector wherein the mating interface of the connector does not seal with the mating interface of the complementary connector when the connectors are mated together. In the illustrated embodiment, the electrical connectors 14 and 16 are open interface connectors because the mating interfaces 74 and 104 do not seal with each other when the electrical connectors 14 and 16 are mated together. Accordingly, the seals provided by the sealing members 44 and 46 provide sealing for the electrical connectors 14 and 16 that otherwise would not be present.

Figure 7:
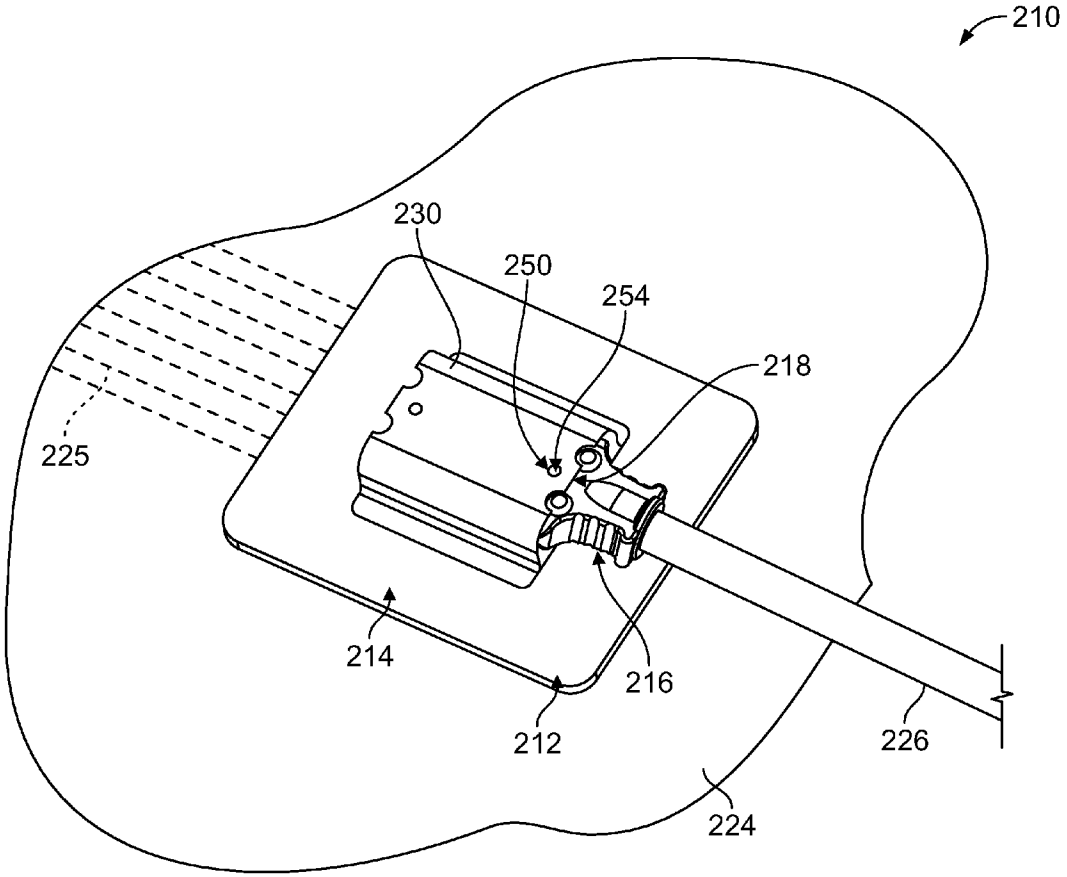
FIG. 7 is a perspective view of another embodiment of an electrical connector system.

FIG. 7 is a perspective view of another embodiment of an electrical connector system 210. The electrical connector system 210 includes an electrical connector 214 and an electrical connector 216 that mate together to form an electrical connection therebetween. The electrical connector system 210 is provided along an electrical path between two electronic devices (not shown) for providing a separable electrical connection between the electronic devices. As will be described below, the electrical connector 214 is mounted to a wearable article 224, such as, but not limited to, a vest, a shirt, a jacket, pants, trousers, a boot, a shoe, a helmet, a hat, a cap, a coat, armor, and/or the like. The electrical connector 216 may be referred to herein as a "mating connector".

In the illustrated embodiment, the electrical connector 216 is electrically connected to the corresponding electronic device via a cable 226. The cable 226 may have any length. In other words, the electrical connector 216 terminates the electrical cable 226. In alternative to the cable 226, the electrical connector 216 may be mounted directly to the corresponding electronic device or may be electrically connected to the corresponding electronic device via an e-textile (not shown) that includes fabrics that enable computing, digital components, electrical pathways, electronic devices, and/or the like to be embedded therein. Specifically, the e-textile provides a wearable article with wearable technology that allows for the incorporation of built-in technological elements into the fabric of the wearable article. The wearable article may constitute intelligent (i.e., smart) clothing.

The electrical connector 214 is mounted to a wearable article 224. In the illustrated embodiment, the wearable article 224 is an e-textile, which includes one or more fabrics that provide electrical pathways 225 from the electrical connector 214 to the corresponding electronic device.

As will be described in more detail below, the electrical connector 214 includes a housing 212 having a shroud 230 that includes a tunnel 218. The tunnel 218 includes terminals 262 (FIGS. 8, 11, and 13) of the electrical connector 214. The tunnel 218 is configured to receive the electrical connector 216 therein such that the electrical connectors 214 and 216 mate together within the tunnel 218.

Figure 8:
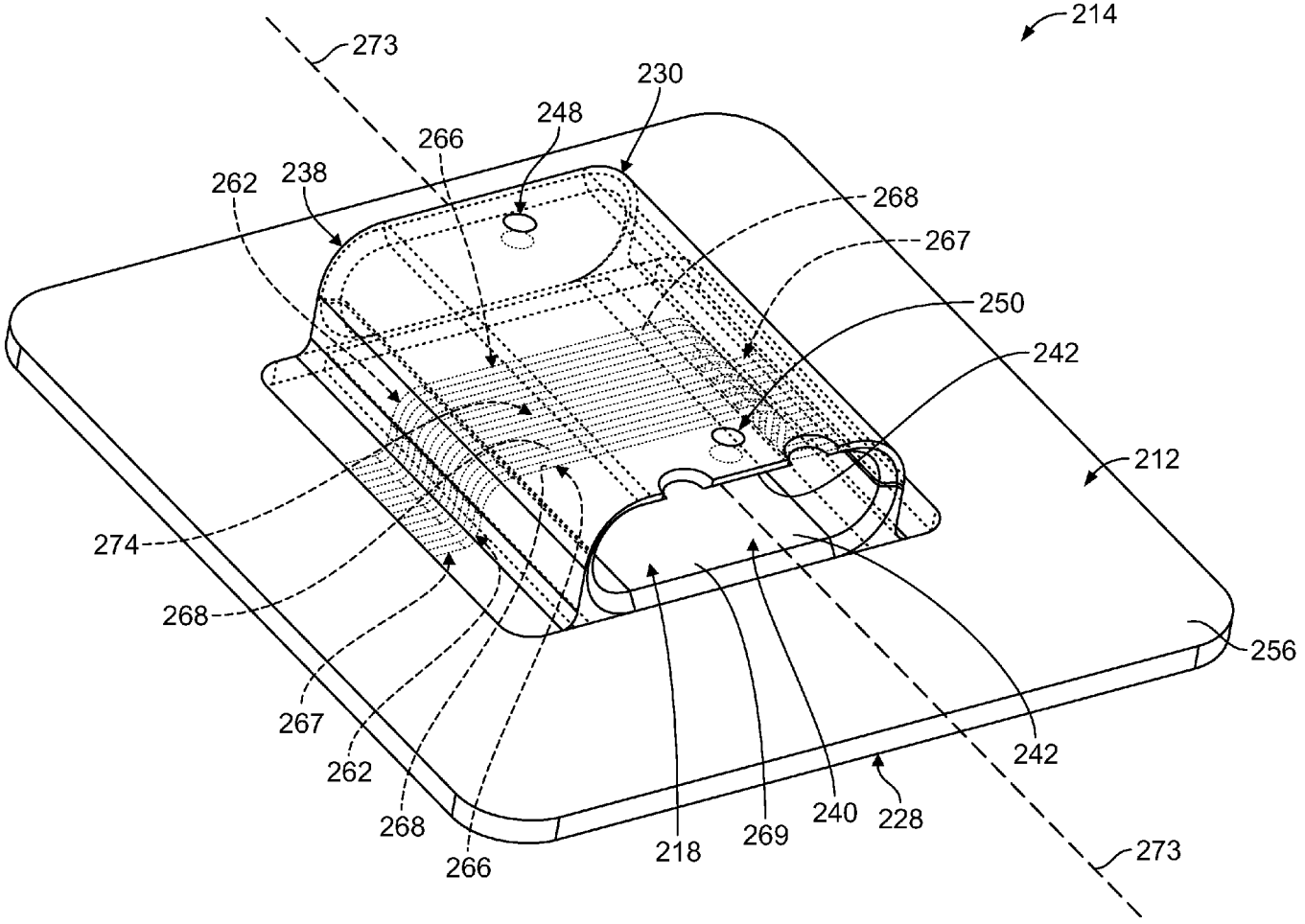
FIG. 8 is a perspective view of an embodiment of an electrical connector of the electrical connector system shown in FIG. 7.

FIG. 8 is a perspective view of an embodiment of the electrical connector 214. The electrical connector 214 includes the housing 212. The housing 212 includes a base 228 and the shroud 230, which extends from the base 228. The shroud 230 is shown in phantom in FIG. 8 for clarity. The shroud 230 includes a tunnel 218. In the illustrated embodiment, the tunnel 218 extends a length through the shroud 230 from an open end 238 to an opposite open end 240. But, in some other embodiments, the end 238 or the end 240 is closed such that the closed end 238 or 240 does not provide an entrance to the tunnel 218. As will be described below, in the illustrated embodiment, the tunnel 218 is configured to selectively receive the electrical connector 216 (FIGS. 7, 12, and 13) therein through the open end 238 or through the open end 240. In other words, each of the open ends 238 and 240 is configured to receive the electrical connector 216 therein to load the electrical connector 216 into the tunnel 218. Each of the open ends 238 and 240 may be referred to herein as a "first" and/or a "second" open end.

The tunnel 218 includes an interior surface 242 that extends along the length of the tunnel 218. As will be described below, the interior surface 242 of the tunnel 218 is configured to sealingly engage in physical contact with sealing members 244 and 246 (FIGS. 12 and 13) of the electrical connector 216 to seal the tunnel 218.

The housing 212 is mounted to the wearable article 224 (FIG. 7) to thereby mount the electrical connector 214 to the wearable article 224. The housing 212 may be mounted to the wearable article 224 using any type of connection, such as, but not limited to, by being sewn to the wearable article, by being adhered to the wearable article using an adhesive, and/or the like. In the illustrated embodiment, the base 228 of the housing 212 includes a flange 256 through which a thread may be routed to sew the housing 212 to the wearable article 224. Optionally, the housing 212 may be mounted to the wearable article within and/or under a pocket and/or other covering of the wearable article 224. For example, a flap and/or one or more other segments of the wearable article may 224 cover at least a portion of the connector 214.

The 212 optionally includes one or more latch features 248 and/or 250 that cooperate with a latch feature 254 (FIGS. 12 and 13) of the electrical connector 216 to hold the electrical connector 216 within the tunnel 218 mated with the electrical connector 214. In the illustrated embodiment, each latch feature 248 and 250 is an opening that receives an embossment of the latch feature 254 therein with a snap-fit connection. But, each latch feature 248 may be any other type of latch feature that facilitates holding the electrical connector 216 within the tunnel 218. Moreover, in some embodiments, the latch feature 254 includes an opening that is configured to receive an embossment of the latch feature 248. Although shown as being located on the shroud 230, additionally or alternatively the latch features 248 and/or 250 may be located on the base 228.

Each of the base 228 and the shroud 230 of the housing 212 may be fabricated from any material(s) having any material properties that enable the housing 212 to function as described and/or illustrated herein, such as, but not limited to, a plastic, a polymer, a composite material, an elastomer, a thermoplastic, a thermoset, a natural material, and/or the like. Optionally, the base 228 of the housing 212 is fabricated from one or more different materials than the shroud 230. For example, the shroud 230 may be fabricated from one or more different materials than the base 228 to provide the shroud 228 with more rigidity and/or more hardness as compared to the base 230. The shroud 230 may be provided with a rigidity and/or hardness that facilitates latching to the electrical connector 216 and/or that facilitates sealing with the electrical connector 216.

The open-ended structure of the tunnel 218 may provide enable the tunnel 18 to be cleaned. For example, a user may use their thumb, a cloth, a rod, and/or the like to remove debris, dirt, other contaminants, and/or the like from inside the tunnel 218 and along the interior surface 242 of the tunnel 218. Moreover, the open-ended structure of the tunnel 218 may trap less dirt, debris, other contaminants, and/or the like than the mating interfaces of at least some known electrical connectors. The open-ended structure of the tunnel 218 may enable the terminals 262 of the electrical connector 214 to be more reliable mated with the terminals 276 (FIGS. 12 and 13) of the electrical connector 216, for example as compared to at least some known electrical connector systems.

As described above, the tunnel 218 of the electrical connector 214 includes the terminals 262. Each of the terminals 262 may be a signal terminal, a ground terminal, or a power terminal. Although eight are shown, the electrical connector 214 may include any number of the terminals 262. Optionally, four of the terminals 262 may be configured to operate at any USB standard, protocol, and/or the like, such as, but not limited to, USB 1.0, USB 2.0, USB 3.0, and/or the like. The tunnel 218 may provide impedance control, such as by positioning the terminals 262 at predetermined locations to achieve a target characteristic impedance.

The terminals 262 include mating segments 266 and mounting segments 267. The terminals 262 are held directly by the shroud 230 of the housing 212 such that the mating segments 266 extend directly on and/or through the interior surface 242 of the tunnel 218. The mating segments 266 have mating surfaces 268 configured for mating with the terminals 276 of the electrical connector 216. The mating surfaces 268 define a mating interface 274 of the electrical connector 214 at which the electrical connector 214 mates with the electrical connector 216.

Figure 9:
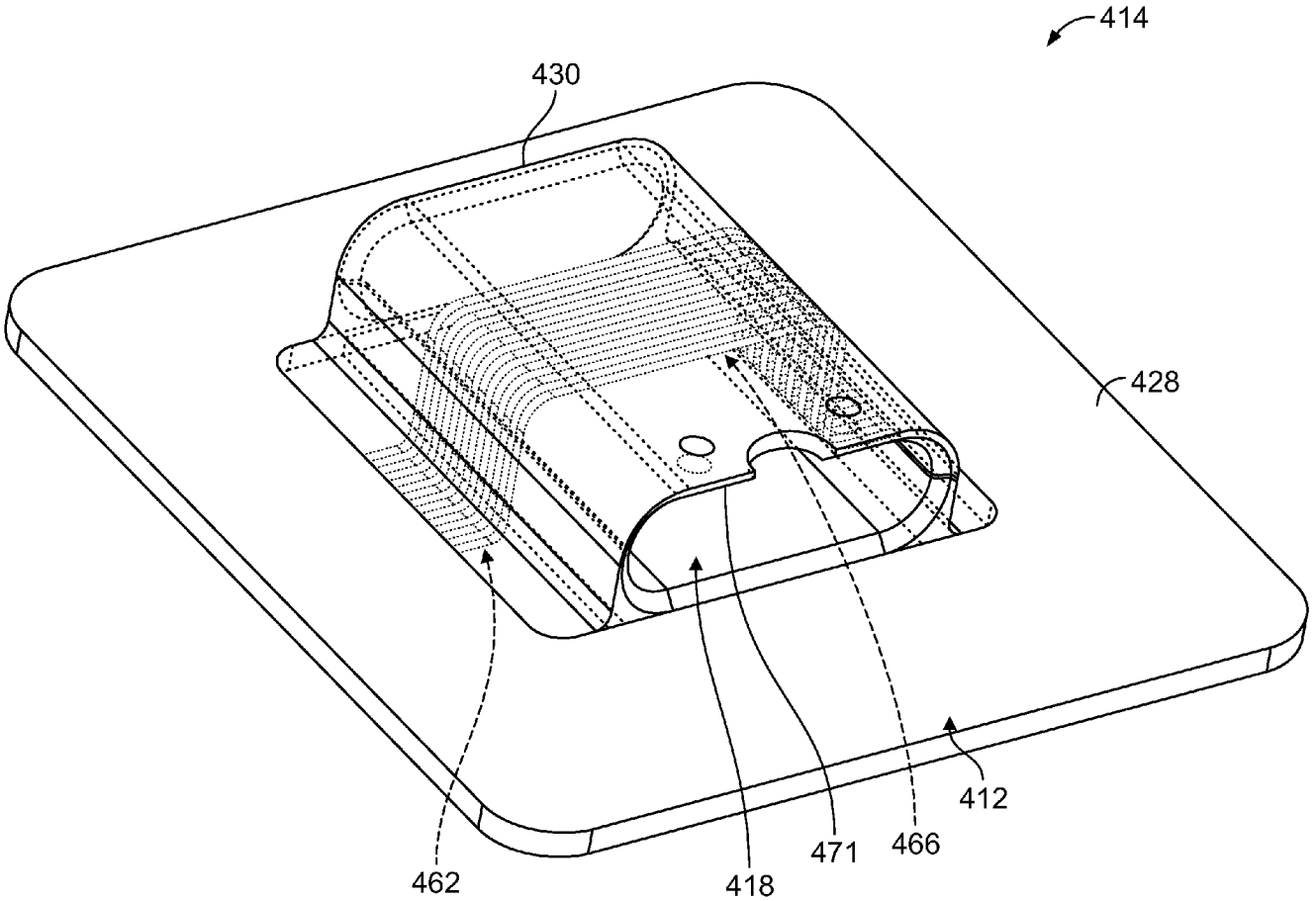
FIG. 9 is a perspective view of another embodiment of an electrical connector that may be used as a component of the electrical connector system shown in FIG. 7.
Figure 12:
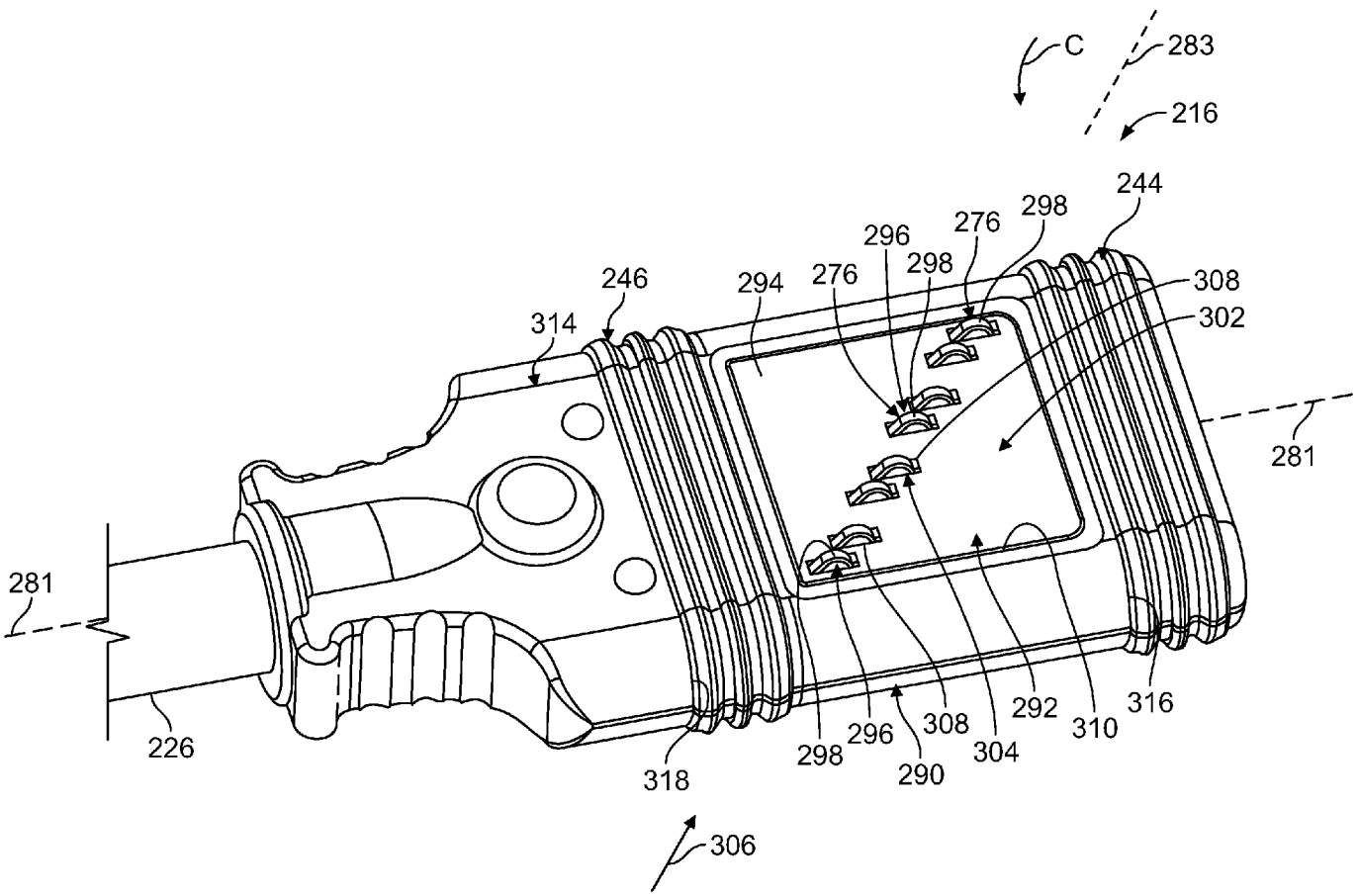
FIG. 12 is a perspective view of an embodiment of another electrical connector of the electrical connector system shown in FIG. 7.
Figure 13:
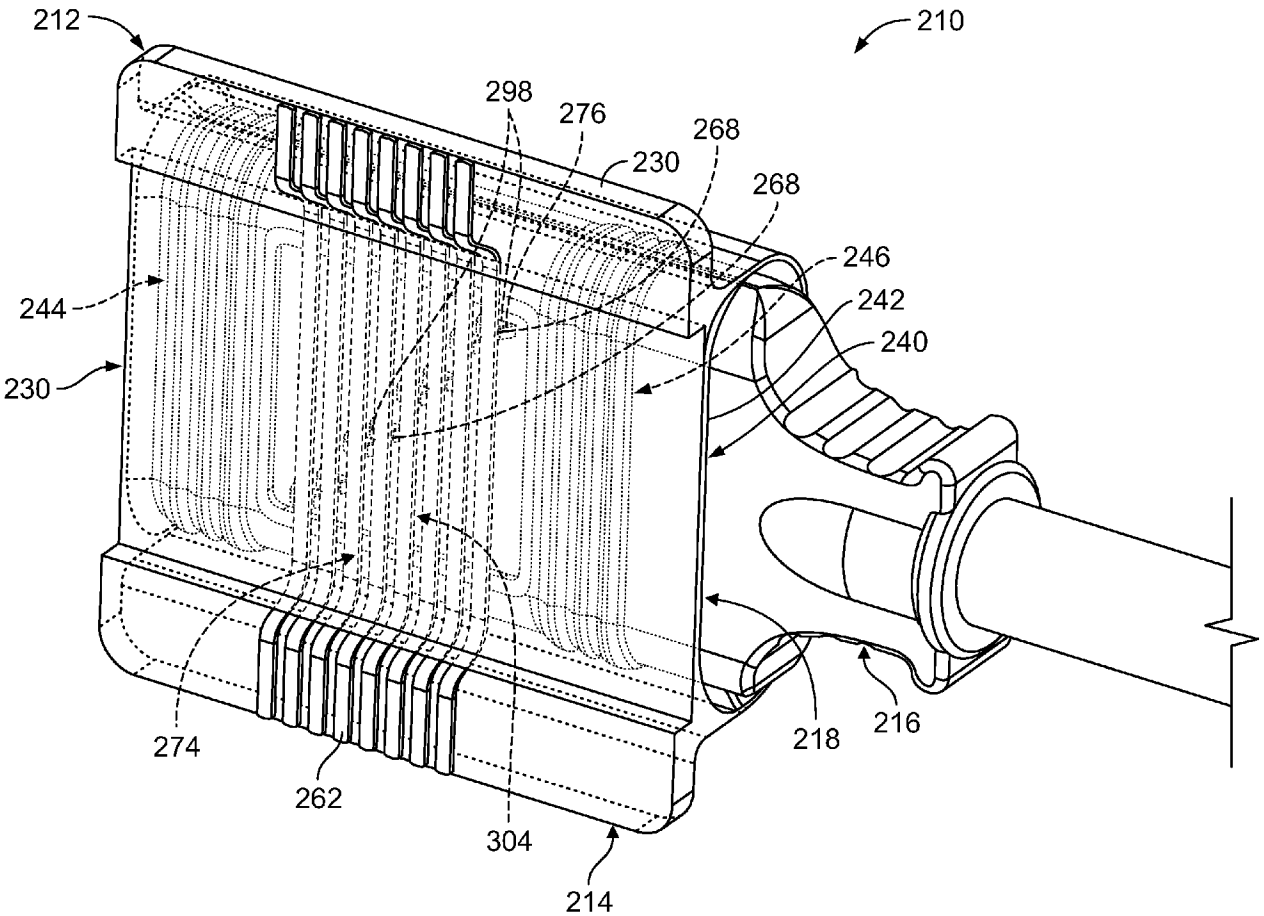
FIG. 13 is a perspective view of the electrical connector system shown in FIG. 7 illustrating the electrical connectors shown in FIGS. 8 and 12 as mated together.

In the illustrated embodiment, the mating segments 266 of the terminals 262 extend along a bottom wall 269 of the shroud 230 for mating with the terminals 276 of the electrical connector 216. But, additionally or alternatively the mating segments 266 of the terminals 262 may extend along any other location along the interior surface 242 of the tunnel 218 for mating with the terminals 276 of the electrical connector 216. For example, FIG. 9 is a perspective view of another embodiment of an electrical connector 414. The electrical connector 414 includes a housing 412 having a base 428 and a shroud 430, which includes a tunnel 418. The electrical connector 414 includes terminals 462 having mating segments 466 that extend along an upper wall 471 of the tunnel 418 for mating with the terminals 276 (FIGS. 12 and 13) of the electrical connector 216 (FIGS. 7, 12, and 13).

Figure 10:
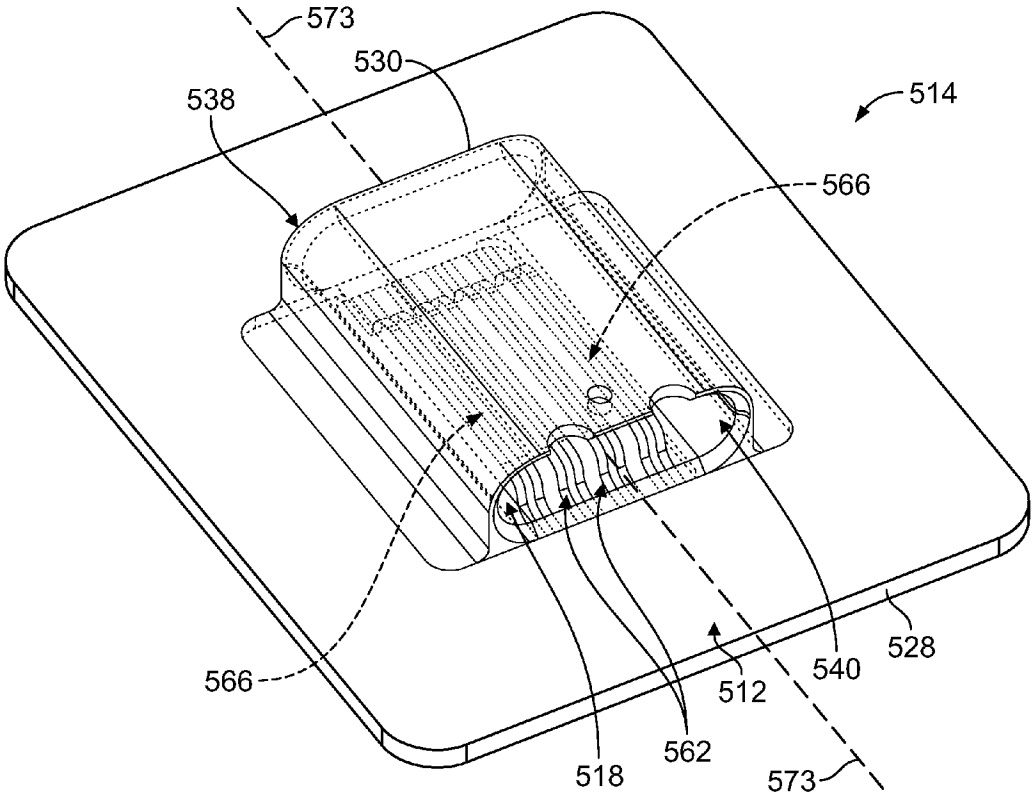
FIG. 10 is a perspective view of another embodiment of an electrical connector that may be used as a component of the electrical connector system shown in FIG. 7.

Referring again to FIG. 8, in the illustrated embodiment, the lengths of the mating segments 266 of the terminals 262 extend approximately perpendicular to the length of the tunnel 218. Accordingly, the lengths of the mating segments 266 extend approximately perpendicular to a loading axis 273 along which the electrical connector 216 is inserted into the tunnel 218. But, the lengths of the mating segments 266 of the terminals 262 may extend at any angle relative to the length of the tunnel 218 and the loading axis 273, such as at an approximately parallel angle or an oblique angle. For example, FIG. 10 is a perspective view of another embodiment of an electrical connector 514. The electrical connector 514 includes a housing 512 having a base 528 and a shroud 530, which includes a tunnel 518. The electrical connector 514 includes terminals 562 having mating segments 566 that extend at an approximately parallel angle relative to the length of the tunnel 518 and relative to a loading axis 573 along which the electrical connector 216 (FIGS. 7, 12, and 13) is configured to be inserted into the tunnel 518.

Figure 11:
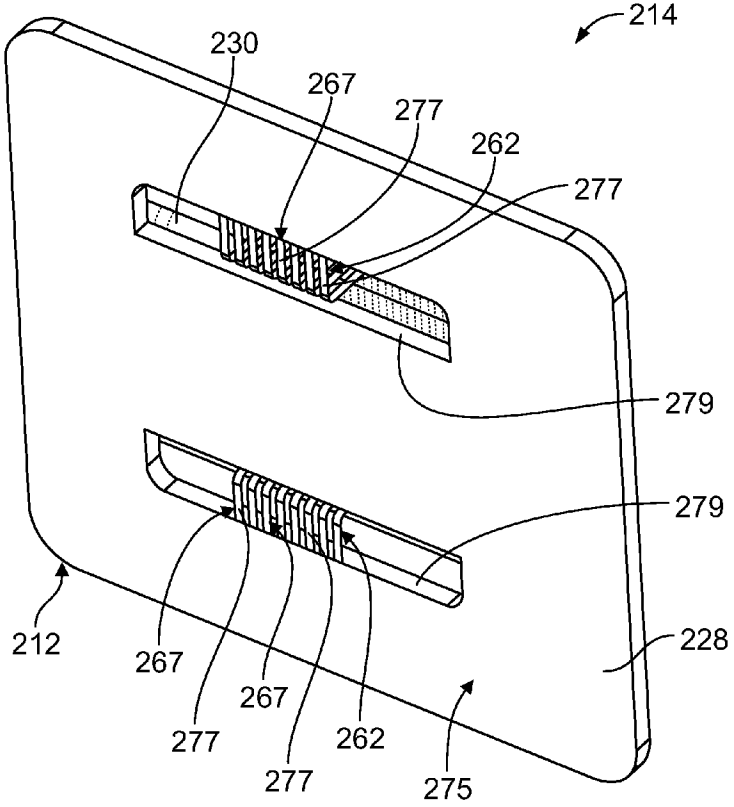
FIG. 11 is another perspective view of the electrical connector shown in FIG. 8 viewed from a different orientation than FIG. 8.

FIG. 11 is a perspective view of the electrical connector 214 illustrating a bottom side 275 of the base 228 of the housing 212. The terminals 262 are held directly by the shroud 230 of the housing 212 such that the mounting segments 267 extend along the bottom side 275 of the base 228. Specifically, the mounting segments 267 include mounting surfaces 277. As can be seen in FIG. 11, the mounting surfaces 277 of the mounting segments 267 are exposed along the bottom side 275 of the base 228 through openings 279 that extend through the base 228. Accordingly, the mounting segments 267 and the mounting surfaces 277 thereof extend along the bottom side 275 of the base 228.

The mounting segments 267 of the terminals 262 are configured to be mounted to the wearable article 224 (FIG. 7) in electrical connection therewith. Specifically, the bottom side 275 of the base 228 is configured to engage in physical contact with the wearable article 224 such that the mounting surfaces 277 of the mounting segments 267 are terminated (i.e., are electrically connected) to corresponding electrical pathways of the wearable article 224 that electrically connect the terminals 262 to the corresponding electronic device. The mounting surfaces 277 may be terminated to the corresponding electrical pathways of the wearable article 224 using any suitable structure, method, process, and/or the, such as, but not limited to, using solder, using a different surface mount arrangement, using a compliant pin, and/or the like.

FIG. 12 is a perspective view of an embodiment of the electrical connector 216. The electrical connector 216 includes a housing 290 and a terminal subassembly 292 that is held by the housing 290. The terminal subassembly 292 includes the terminals 276, which are electrically connected to corresponding electrical conductors (not shown) of the cable 226 (also shown in FIG. 12). The terminal subassembly 292 may include an insulator 294 that holds the terminals 276. The insulator 294 may provide impedance control, such as by positioning the terminals 276 at predetermined locations to achieve a target characteristic impedance.

Each of the terminals 276 may be a signal terminal, a ground terminal, or a power terminal. Although eight are shown, the electrical connector 216 may include any number of the terminals 276. Four of the terminals 276 are optionally configured to operate at any USB standard, protocol, and/or the like, such as, but not limited to, USB 1.0, USB 2.0, USB 3.0, and/or the like. The terminals 276 may be referred to herein as a "mating" terminals.

The terminal subassembly 292 optionally includes an electrically conductive shield (not shown) that extends at least partially around the terminals 276. The shield may provide electrical shielding to the terminals 276, which may prevent or reduce EMI and/or RFI on signal paths defined through the electrical connector 216. Electrical shielding provided by the shield may allow relatively high speed data to be uninterrupted by the electrical connector 216. The shield is optionally electrically connected to a ground conductor (not shown) of the cable 226.

The terminals 276 include mating ends 296 having mating surfaces 298 configured for mating with the terminals 262 (FIGS. 8, 11, and 13) of the electrical connector 214 (FIGS. 7, 8, 11, and 13). The insulator 294 has a terminal side 302 along which the mating ends 296 of the terminals 276 are arranged. The mating surfaces 298 of the terminals 276 define a mating interface 304 of the electrical connector 216 at which the electrical connector 216 mates with the electrical connector 214. The mating surfaces 298 mate with the corresponding terminals 262 of the electrical connector 214 at the mating interface 304. In the illustrated embodiment, the mating ends 296 of the terminals 276 are deflectable springs that are configured to deflect generally in the direction of the arrow C when mated with the terminals 262 of the electrical connector 214. Alternatively, the mating ends 296 have a different structure.

The mating ends 296 of the terminals 276 extend within corresponding grooves 308 of the insulator 294. The mating ends 296 are configured to be deflected into or further into the corresponding grooves 308 when the mating ends 296 are mated with the terminals 262 of the electrical connector 214. The terminal side 302 of the insulator 294 is configured to protect the mating ends 296 of the terminals 276 from over-deflection. Specifically, the terminal side 302 of the insulator 294 is aligned with a predetermined deflected position of the mating ends 296 that represents a maximum desired deflection of the mating ends 296. Accordingly, as a structure (e.g., the electrical connector 214) engages the mating ends 296 of the terminals 276, the structure will engage the terminal side 302 of the insulator 294 such that the structure cannot move the mating surfaces 298 of the mating ends 296 past the terminal side 302. The terminal side 302 thus prevents the mating ends 296 from being deflected to or past a position where the mating ends 296 are damaged from being deflected past the working range of the mating ends 296.

The mating interface 304 of the electrical connector 216 is optionally approximately flat. For example, the mating surface 298 of each of the terminals 276 is approximately flat, at least once the mating end 296 is deflected after being mated with the corresponding terminal 262. Specifically, the mating surfaces 298 of the terminals 276 extend approximately within the same plane. The approximately flat shapes of the mating surfaces 298 and the alignment within the common plane provides the mating interface 304 of the electrical connector 216 as approximately flat, at least once the mating ends 296 have been deflected after being mated with the corresponding terminals 262.

Optionally, the mating ends 296 of the terminals 276 are staggered relative to a central longitudinal axis 281 of the electrical connector 216, and are thus staggered relative to the loading axis 273 (FIG. 8), which extends approximately parallel with the central longitudinal axis 281 when the electrical connector 216 is mated with the electrical connector 214. Specifically, the mating ends 296 of the terminals 276 are arranged side by side in a row 306, which extends along a row axis 283. As can be seen in FIG. 12, the row axis 283 extends at an oblique angle relative to the central longitudinal axis 281 (and thus relative to the loading axis 273). Although shown as extending at an angle of approximately 45°, the row axis 283 may extend at any other oblique angle relative to the central longitudinal axis 281 (and thus relative to the loading axis 273). Moreover, in some other embodiments, the row axis 283 extend at an approximately perpendicular angle relative to the central longitudinal axis 281 (and thus relative to the loading axis 273).

In the illustrated embodiment, and as can be seen in FIG. 12, the mating interface 304 of the electrical connector 216 is exposed when the connector 216 is not mated with the electrical connector 214. Specifically, the terminal side 302 of the insulator 294 is exposed from (i.e., not covered by) the housing 290 through an opening 310 of the housing 290. The mating ends 296 of the terminals 276 extend along the terminal side 302 of the insulator 294 such that the mating interface 304 of the electrical connector 216 is exposed from the housing 290.

The approximately flat structure and/or the exposure of the mating interface 304 of the electrical connector 216 may provide a wipeable and/or cleanable surface for cleaning the mating surfaces 298 of the terminals 276. For example, a user may use their thumb, a cloth, and/or the like to wipe across the mating interface 304 to clear debris, dirt, other contaminants, and/or the like from the terminals 276. Moreover, the approximately flat structure and/or the exposure of the mating interface 304 may trap less dirt, debris, other contaminants, and/or the like than the mating interfaces of at least some known electrical connectors. The approximately flat structure and/or the exposure of the mating interface 304 may thus enable the mating surfaces 298 of the terminals 276 to be more reliable and/or be more easily cleaned than the terminals of at least some known electrical connectors. For example, the approximately flat structure and/or the exposure of the mating interface 304 may enable the mating surfaces 298 of the terminals 276 to be cleaned without damaging the terminals 76.

The electrical connector 216 optionally includes sealing members 244 and 246, which extend around the housing 290. Specifically, the sealing members 244 and 246 extend along an exterior side 314 of the housing 290. Each of the sealing members 244 and 246 is configured to sealingly engage in physical contact with the interior surface 242 (FIGS. 8 and 13) of the tunnel 218 of the electrical connector 214 to facilitate sealing the tunnel 218. Each of the sealing members 244 and 246 may have any size, shape, materials, structure, and/or the like that enables the sealing member to form a seal with the tunnel 218 (i.e., sealingly engage in physical contact with the interior surface 242 of the tunnel 218). Optionally, the sealing member 244 and/or the sealing member 246 is elastomeric. The housing 290 optionally includes one or more grooves 316 and/or 318 that holds the sealing members 244 and 246, respectively, therein. Each of the sealing members 244 and 246 may be referred to herein as a "first" and/or a "second" sealing member.

FIG. 13 is a perspective view of the electrical connector system 210 illustrating the electrical connectors 214 and 216 as mated together within the tunnel 218 of the electrical connector 214. The shroud 230 of the housing 212 of the electrical connector 214 is shown in phantom in FIG. 13 to better illustrate the mating of the electrical connectors 214 and 216. The base 228 (FIGS. 7 and 8) of the housing 212 of the electrical connector 214 is not shown in FIG. 13 for clarity.

To mate the electrical connectors 214 and 216 together, the electrical connector 216 is inserted into the tunnel 218 of the electrical connector 214 through either of the open ends 238 or 240. In the illustrated embodiment, the electrical connector 216 is received (i.e., inserted; i.e., loaded) into the tunnel 218 through the open end 240.

As shown in FIG. 13, the electrical connector 216 has been received into the tunnel 218 of the electrical connector 214 such that the connectors 214 and 216 are mated together within the tunnel 218. Specifically, the electrical connectors 214 and 216 are mated together at the respective mating interfaces 274 and 304 such that the mating surfaces 268 of the terminals 262 of the electrical connector 214 are engaged in physical contact with, and thereby electrically connected to, the mating surfaces 298 of the terminals 276 of the electrical connector 216. The electrical connectors 214 and 216 are thus mated together within the tunnel 218 to establish an electrical connection between the electrical connectors 214 and 216, and thus between the electronic devices. The electrical connectors 214 and 216 may be considered "blind mate" connectors because the mating interfaces 274 and 304 are not visible (i.e., are obscured by the shroud 230) as the electrical connectors 214 and 216 are mated together within the tunnel 218.

Although the electrical connector 216 has been received into the tunnel 218 of the electrical connector 214 through the open end 240 in the illustrated embodiment, as briefly described above, the tunnel 218 is configured to selectively receive the electrical connector 216 therein through the open end 238 or through the open end 240. In other words, each of the open ends 238 and 240 is configured to receive the electrical connector 216 therein to receive (i.e., load) the electrical connector 216 into the tunnel 218. Accordingly, the electrical connector 216 may be mated with the electrical connector 214 within the tunnel 218 by inserting the electrical connector 216 into the tunnel 218 through the open end 238 instead of through the open end 240. It should be understood that when the electrical connector 216 has been received into the tunnel through the open end 238, the mating surfaces 268 of the terminals 262 of the electrical connector 214 are engaged in physical contact with, and thereby electrically connected to, the mating surfaces 298 of the terminals 276 of the electrical connector 216.

In the embodiment of the electrical connector 214, the pin out pattern between the electrical connectors 214 and 216 is reversed when the electrical connector 216 is received into the tunnel 218 through the open end 240 as compared to when the electrical connector 216 is received into the tunnel 218 through the open end 238. In other words, when the electrical connector 216 is received into the open end 240, the terminals 276 of the electrical connector 216 will mate with different ones (in a reverse pattern) of the terminals 262 of the electrical connector 214 as compared to when the electrical connector 216 is received into the tunnel 218 through the open end 238. But, in the embodiment of the electrical connector 514 shown in FIG. 10, the pin out pattern between the electrical connectors 414 and 216 remains the same for when the electrical connector 216 is received into the tunnel 518 through the open end 540 and for when the electrical connector 216 is received into the tunnel 518 through the open end 538. In other words, when the electrical connector 216 is received into the open end 540, the terminals 276 of the electrical connector 216 will mate with the same ones of the terminals 562 of the electrical connector 514 as compared to when the electrical connector 216 is received into the tunnel 518 through the open end 538.

As shown in FIG. 13, the sealing members 244 and 246 of the electrical connector 216 are each sealingly engaged in physical contact with the interior surface 242 of the tunnel 218. The seals created by the sealing engagement between the sealing members 244 and 246 and the interior surface 242 seals the open ends 238 and 240 of the tunnel 218. For example, the seals provided by the sealing members 244 and 246 may provide the open ends 238 and 240 of the tunnel 218 as liquid and/or moisture tight (e.g., water tight). The liquid and/or moisture may be any type (i.e., may be formed of any substance(s)) of liquid and/or moisture, such as, but not limited to, water, a corrosive liquid, an acidic liquid, humidity, dew, and/or the like. By "liquid and/or moisture tight", it is meant that one or more particular types of liquids and/or one or more particular types moistures cannot pass the seal created by the sealing engagement between the sealing member and the interior surface 242 of the tunnel 218.

As can also be seen in FIG. 13, the mating interfaces 274 and 304 of the electrical connectors 214 and 216, respectively, extend between the sealing members 244 and 246 along the length of the tunnel 218 when the electrical connectors 214 and 216 are mated together within the tunnel 218. The mating interfaces 274 and 304 thus extend between the seals provided by the sealing members 244 and 246 when the electrical connectors 214 and 216 are mated together within the tunnel 218. The seals provided by the sealing members 244 and 246 may provide the mated interface between the electrical connectors 214 and 216 within the tunnel 218 as liquid and/or moisture tight. The seals provided by the sealing members 244 and 246 may protect the electrical connectors 214 and 216 from damage caused by exposure to liquid and/or moisture, such that exposure to liquid and/or moisture does not interfere with operation of the electrical connector system 210. The seals provided by the sealing members 244 and 246 may enable the electrical connector system 210 to be used in environments wherein the electrical connector system 210 is exposed to a liquid and/or moisture. For example, the seals provided by the sealing members 244 and 246 may enable the electrical connector system 210 to be used in environments wherein the electrical connector system 210 is at least partially submerged (i.e., immersed) in a liquid (e.g., water and/or the like).

Optionally, the electrical connectors 214 and 216 are open interface connectors. In the illustrated embodiment, the electrical connectors 214 and 216 are open interface connectors because the mating interfaces 274 and 304 do not seal with each other when the electrical connectors 214 and 216 are mated together. Accordingly, the seals provided by the sealing members 244 and 246 may provide sealing for the electrical connectors 214 and 216 that otherwise would not be present.

Referring again to FIG. 7, the latch feature 254 of the electrical connector 216 cooperates with the latch feature 250 of the housing 212 of the electrical connector 214 to facilitate holding the electrical connector 216 within the tunnel 218 of the electrical connector 214 and/or to facilitate holding the electrical connectors 214 and 216 as mated together. Specifically, the embossment of the latch feature 254 is received within the opening of the latch feature 250.

Figure 14:
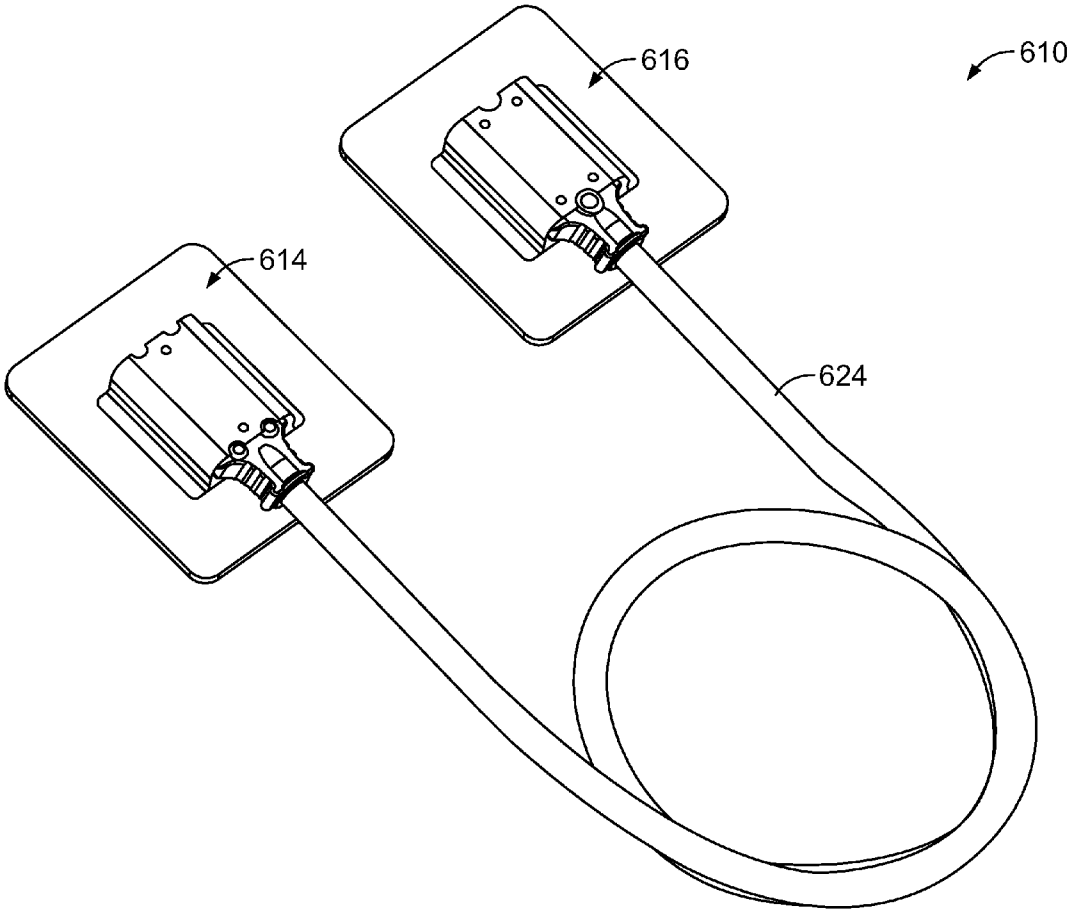
FIG. 14 is a perspective view of another embodiment of an electrical connector system.

FIG. 14 is a perspective view of another embodiment of an electrical connector system 610. The electrical connector system 610 includes two electrical connector sub-systems 614 and 616 and a cable 624 electrically connects the sub-systems 614 and 616 together. Each electrical connector sub-system 614 and 616 is substantially similar to the electrical connector system 210 shown in FIGS. 7 and 13 and therefore will not be described in more detail herein.

The electrical connector system 610 is provided along an electrical path between two electronic devices (not shown) for providing a separable electrical connection between the electronic devices. Each of the electrical connector sub-systems 614 and 616 may be electrically connected to the corresponding electronic device via a cable, by being mounted directly to the corresponding electronic device, or via an e-textile of a wearable article.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector system comprising:

a holder comprising a base and a shroud that extends from the base, the shroud comprising a tunnel that extends a length from a first open end to a second open end, the base being configured to be mounted to a wearable article;

a first connector having a first group of terminals, the first connector including a first platform with a terminal side that is flat, the first group of terminals having mating surfaces arranged side by side in a row along the terminal side of the first platform, the first connector configured to be selectively received into the tunnel of the shroud through both the first open end and the second open end; and a second connector having a second group of terminals, the second connector including a second platform with a terminal side that is flat, the second group of terminals having mating surfaces arranged side by side in a row along the terminal side of the second platform, the second connector configured to be selectively received into the tunnel of the shroud through both the first open end and the second open end, the second connector being configured to mate with the first connector within the tunnel such that the second group of terminals is mated with the first group of terminals, wherein, in a first mating configuration, the first and second connectors are received into the tunnel of the holder through the first and second open ends, respectively, and, in a second mating configuration, the first and second connectors are received into the tunnel of the shroud through the second and first open ends, respectively, wherein the first and second connectors are received in the tunnel such that the first platform of the first connector at least partially overlaps the second platform of the second connector along the length of the tunnel, the terminal side of the first platform facing the terminal side of the second platform.

2. The connector system of claim 1, wherein the first connector comprises a sealing member that extends along an exterior side of the first connector, the sealing member being configured to sealingly engage in physical contact with an interior surface of the tunnel of the shroud when the first connector is received into the tunnel.

3. The connector system of claim 1, wherein the first and second connectors mate together within the tunnel at mating interfaces of the first and second connectors, the first and second electrical connectors comprising first and second sealing members, respectively, that are configured to sealingly engage in physical contact with an interior surface of the tunnel of the shroud, wherein the mating interfaces extend between the first and second sealing members along the length of the tunnel when the first and second connectors are mated together within the tunnel.

4. The connector system of claim 1, wherein the shroud of the holder comprises a latch feature that cooperates with a latch feature on the first connector to hold the first connector within the tunnel of the shroud.

5. The connector system of claim 1, wherein the base of the holder is fabricated from a different material than the shroud of the holder.

6. The connector system of claim 1, wherein at least one of the first connector or the second connector comprises a sealing member that is configured to sealingly engage in physical contact with an interior surface of the tunnel of the shroud for sealing at least one of the first open end or the second open end, respectively, of the tunnel.

7. The connector system of claim 1, wherein the first connector is releasably coupled to the shroud and the second connector, and the second connector is releasably coupled to the shroud and the first connector.

8. A connector system comprising:

a first connector having a first group of terminals, the first connector including an approximately flat mating interface;

a second connector having a second group of terminals, the second connector including an approximately flat mating interface, the second connector being configured to mate with the first connector at the mating interfaces of the first and second connectors such that the second group of terminals is mated with the first group of terminals; and a holder comprising a generally planar base having a top side and an opposite bottom side, the base extending along a longitudinal axis between a first end and a second end, the holder further comprising a shroud that extends from the top side of the base, the shroud comprising a tunnel that extends a length along the longitudinal axis from a first open end to a second open end, the first and second open ends both provided above the top side of the base, the tunnel having a rectangular cross-sectional shape defined by an upper wall, a lower wall, and two side walls extending between the upper and lower walls, the base having a length along the longitudinal axis that is greater than a respective length of the shroud, the base including a flange along at least the first end and the second end that is configured to be affixed to a wearable article, the holder configured to releasably receive the first and second connectors within the tunnel of the shroud through the first and second open ends, respectively, such that the first and second connectors mate together within the tunnel and are held relative to the wearable article, the approximately flat mating interfaces of the first and second connectors within the tunnel extending parallel to the upper and lower walls.

9. The connector system of claim 8, wherein the first and second connectors are each configured to be selectively received into the tunnel of the shroud through both the first open end and the second open end, wherein, in a first mating configuration, the first and second connectors are received into the tunnel of the shroud through the first and second open ends, respectively, and, in a second mating configuration, the first and second connectors are received into the tunnel of the shroud through the second and first open ends, respectively.

10. The connector system of claim 8, wherein the shroud includes first latch features proximate to the first open end and second latch features proximate to the second open end, the first connector including a first squeeze latch protruding from the first open end of the tunnel, the first squeeze latch configured to cooperate with the first latch features of the shroud to releasably hold the first connector within the tunnel, the second connector including a second squeeze latch protruding from the second open end of the tunnel, the second squeeze latch configured to cooperate with the second latch features of the shroud to releasably hold the second connector within the tunnel.

11. The connector system of claim 8, wherein the first and second electrical connectors comprise first and second sealing members, respectively, that are configured to sealingly engage in physical contact with an interior surface of the tunnel of the shroud, wherein the mating interfaces extend between the first and second sealing members along the length of the tunnel when the first and second connectors are mated together within the tunnel.

12. The connector system of claim 8, wherein the base of the holder is fabricated from a different material than the shroud of the holder.

13. The connector system of claim 8, wherein the flange extends along an entire perimeter of the generally planar base.

14. The connector system of claim 8, wherein the first connector includes a first platform with a terminal side that is flat, the first group of terminals having mating surfaces arranged side by side in a row along the terminal side of the first platform, the second connector including a second platform with a terminal side that is flat, the second group of terminals having mating surfaces arranged side by side in a row along the terminal side of the second platform, wherein the first and second connectors mate together within the tunnel such that the first platform of the first connector at least partially overlaps the second platform of the second connector along the length of the tunnel, the terminal side of the first platform facing the terminal side of the second platform.

15. The connector system of claim 8, wherein the top side of the base defines the lower wall of the tunnel and the shroud defines the upper wall and the side walls of the tunnel.

16. A connector system comprising:

a holder comprising a base and a shroud that extends from the base, the shroud comprising a tunnel that extends a length from a first open end to a second open end, the shroud including first latch features proximate to the first open end and second latch features proximate to the second open end, the base being configured to be mounted to a wearable article;

a first connector having a first group of terminals, the first connector having a front end and a rear end, the first connector configured to be received in the tunnel of the shroud through the first open end such that the front end is within the tunnel and the rear end is outside of the tunnel, the first connector including a first squeeze latch at or near the rear end and protruding from the tunnel, the first squeeze latch having squeeze latch members configured to cooperate with the first latch features of the shroud to releasably hold the first connector within the tunnel; and a second connector having a second group of terminals, the second connector having a front end and a rear end, the second connector configured to be received in the tunnel of the shroud through the second open end such that the front end is within the tunnel and the rear end is outside of the tunnel, the second connector including a second squeeze latch at or near the rear end and protruding from the tunnel, the second squeeze latch having squeeze latch members configured to cooperate with the second latch features of the shroud to releasably hold the second connector within the tunnel, the second group of terminals of the second connector mating with the first group of terminals of the first connector within the tunnel, wherein the first group of terminals and the second group of terminals mate together within the tunnel at mating interfaces of the first and second connectors, the first and second electrical connectors comprising first and second sealing members, respectively, that are configured to sealingly engage in physical contact with an interior surface of the tunnel of the shroud, wherein the mating interfaces extend between the first and second sealing members along the length of the tunnel when the first and second connectors are mated together within the tunnel.

17. The connector system of claim 16, wherein the first connector is releasably coupled to the shroud and the second connector, and the second connector is releasably coupled to the shroud and the first connector.

18. The connector system of claim 16, wherein the base is generally planar and has a top side and an opposite bottom side, the shroud extending from the top side of the base, the first and second open ends of the tunnel both being provided above the top side of the base.

19. The connector system of claim 16, wherein the first and second connectors are each configured to be selectively received into the tunnel of the shroud through both the first open end and the second open end, wherein, in a first mating configuration, the first and second connectors are received into the tunnel of the shroud through the first and second open ends, respectively, and, in a second mating configuration, the first and second connectors are received into the tunnel of the shroud through the second and first open ends, respectively.

20. The connector system of claim 16, wherein the base of the holder is fabricated from a different material than the shroud of the holder.

* * * * *